US009527316B2

(12) United States Patent
Mori et al.

(10) Patent No.: US 9,527,316 B2
(45) Date of Patent: Dec. 27, 2016

(54) PRINTING APPARATUS

(71) Applicant: SEIKO EPSON CORPORATION, Tokyo (JP)

(72) Inventors: Kazunori Mori, Matsumoto (JP); Satoshi Chiba, Suwa (JP); Yoshikazu Koike, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/051,496

(22) Filed: Feb. 23, 2016

(65) Prior Publication Data

US 2016/0246244 A1 Aug. 25, 2016

(30) Foreign Application Priority Data

Feb. 25, 2015 (JP) ..... 2015-035395
Jan. 13, 2016 (JP) ..... 2016-004162

(51) Int. Cl.
*B41J 11/00* (2006.01)
*B41J 15/04* (2006.01)

(52) U.S. Cl.
CPC ..... *B41J 11/0085* (2013.01); *B41J 11/007* (2013.01); *B41J 15/048* (2013.01)

(58) Field of Classification Search
CPC ..... G03G 21/06; B41J 11/0085; B41J 11/007; B41J 15/048
See application file for complete search history.

(56) References Cited

U.S. PATENT DOCUMENTS

2007/0109385 A1 5/2007 Imoto et al.
2011/0261130 A1* 10/2011 Hirai ..... B41J 29/17 347/104
2012/0154472 A1* 6/2012 Sakamoto ..... B41J 11/007 347/16

FOREIGN PATENT DOCUMENTS

JP 2005-324877 11/2005
JP 2008-096551 4/2008
JP 2008-162807 7/2008
JP 2009-007119 1/2009

* cited by examiner

*Primary Examiner* — Alessandro Amari
*Assistant Examiner* — Roger W Pisha, II
(74) *Attorney, Agent, or Firm* — Workman Nydegger

(57) ABSTRACT

In a printing apparatus, an end of a destaticization section in a definition direction is positioned further on an outer side than an end of a transport belt in the definition direction. In addition, the printing apparatus is provided with an operation mechanism section that changes a location of the destaticization section that comes into contact with a sheet of paper, which is electrostatically adsorbed to the transport belt, by operating the destaticization section.

17 Claims, 14 Drawing Sheets

PRINTING APPARATUS

BACKGROUND

1. Technical Field

The present invention relates to a printing apparatus that carries out printing on a printing medium that is electrostatically adsorbed to a transport belt.

2. Related Art

Printing apparatuses that electrostatically adsorb sheets of paper, which are an example of a printing medium, to a charged transport belt, and carry out printing on sheets of paper in such a state, are known. Of the two surfaces of sheets of paper, in a case in which the surface that comes into contact with the transport belt is set as a contact surface, and the surface that is on the opposite side to the contact surface is set as a printing surface, in such a printing apparatus, a printing material is adhered to the printing surface of sheets of paper.

Additionally, in such a printing apparatus, in order to increase the size of an electrostatic adsorption force of sheets of paper by the transport belt, a destaticization brush is provided as a destaticization section for removing an electric charge from the printing surface of sheets of paper. The destaticization brush can remove an electric charge from the printing surface by coming into contact with the printing surface of sheets of paper that are transported in a predetermined transport direction. Therefore, it is easy for foreign matter such as paper debris to become adhered to the destaticization brush. Further, as an adherence amount of foreign matter to the destaticization brush becomes greater, a removal efficiency of an electric charge from sheets of paper by the destaticization brush decreases.

In such an instance, JP-A-2008-96551 discloses an example of a configuration that suppresses reductions in the removal efficiency of an electric charge from sheets of paper by the destaticization brush. That is, a destaticization section which includes a rotational shaft that extends in a width direction of sheets of paper, and a plurality of destaticization brushes that are attached to the rotational shaft, is provided in a printing apparatus that is disclosed in JP-A-2008-96551. Each destaticization brush is disposed along a circumferential direction of the rotational shaft. Therefore, it is possible to change a destaticization brush that comes into contact with sheets of paper by adjusting a rotational angle of the rotational shaft.

In addition, a cleaning member for eliminating foreign matter such as paper debris from the destaticization brushes that are attached to the rotational shaft, is provided in the above-mentioned printing apparatus. That is, the cleaning member comes into contact with the destaticization brushes that are not in contact with sheets of paper, and removes foreign matter from the destaticization brushes which the cleaning member comes into contact with as a result of the rotational shaft rotating. Accordingly, in the above-mentioned printing apparatus, since it is possible to bring destaticization brushes, for which the adherence amount of foreign matter is low, into contact with sheets of paper, reductions in the removal efficiency of an electric charge from sheets of paper by the destaticization brushes are suppressed. As a result of this, it is possible to suppress reductions in an electrostatic adsorption force of sheets of paper by the transport belt.

In the printing apparatus that is disclosed in JP-A-2008-96551, the destaticization brushes abut against sheets of paper across the width direction of the sheets of paper. That is, locations of the destaticization brushes that abut against sheets of paper are fixed in the width direction of the sheets of paper. Therefore, there is a concern that it will be easy for foreign matter to become adhered to the destaticization brushes, and therefore, that the removal efficiency of an electric charge from sheets of paper by the destaticization brushes will be reduced.

In addition, in the printing apparatus that is disclosed in JP-A-2008-96551, the above-mentioned rotational shaft is disposed in an upper region of the transport belt, and cleaning of the destaticization brushes is performed by rotating the corresponding rotational shaft. At this time, there is a concern that foreign matter that becomes detached from the destaticization brushes as a result of coming into contact with the cleaning member will become adhered to sheets of paper that are being transported, will become adhered to a printing section, which is positioned further on a downstream side in a transport direction of sheets of paper than the destaticization brushes, or the like, and that printing quality on the sheets of paper will be reduced as a result.

SUMMARY

An advantage of some aspects of the invention is to provide a printing apparatus that can suppress reductions in the removal efficiency of an electric charge from a printing medium by a destaticization section. In addition, another advantage of some aspects of the invention is to provide a printing apparatus that can suppress reductions in the printing quality on a printing medium that are caused by cleaning of a destaticization section.

According to an aspect of the invention, there is provided a printing apparatus including a transport belt, to which a printing medium is electrostatically adsorbed, and which operates in a manner that transports the printing medium in a transport direction, a printing head that carries out printing on a printing surface of the printing medium, which is electrostatically adsorbed to the transport belt, and a destaticization section that is disposed further upstream in the transport direction than the printing head, and that removes an electric charge from the printing surface by coming into contact with the printing surface of a printing medium, which is electrostatically adsorbed to the transport belt, in which, in a case in which a direction which runs along the printing surface of the printing medium that is transported on the transport belt, and of which a width direction of the printing medium is the main component, is set as a definition direction, an end of the destaticization section in the definition direction is positioned further on an outer side than an end of the transport belt in the definition direction, and in which an operation mechanism section that changes a location in the definition direction of the destaticization section that comes into contact with a printing medium, which is electrostatically adsorbed to the transport belt, by operating the destaticization section, is provided.

In this case, when the destaticization section comes into contact with a printing medium, which is electrostatically adsorbed to the transport belt, foreign matter that is adhered to the printing medium becomes adhered to a contact location of the destaticization section with the printing medium. In such an instance, in the above-mentioned configuration, as a result of the destaticization section being operated due to action of the operation mechanism section, it is possible to change the location of the destaticization section that comes into contact with a printing medium during printing on a subsequent printing medium. As a result of this, since it is possible to cause a location of the destaticization section for which the adherence amount of foreign matter is low, come into contact with a printing medium, it is possible to efficiently remove an electric charge from the printing surface of a printing medium by using the destaticization section. As a result of this, reductions in an electrostatic adsorption force of a printing medium by the transport belt, are suppressed.

It is preferable that the printing apparatus further includes a cleaning section that performs cleaning of the destaticization section at a position that is further on an outer side in the definition direction than the transport belt.

In this case, when the destaticization section is operated in this manner, it is possible to perform cleaning of the destaticization section using the cleaning section. Since such cleaning of the destaticization section is performed at a position that is further on an outer side in the definition direction than the transport belt, it is difficult for phenomena such as foreign matter that becomes detached from the destaticization section as a result of cleaning becoming adhered to a printing medium that is being transported, becoming adhered to the printing head, which is positioned further on a downstream side in the transport direction than the destaticization section, or the like, to occur. Accordingly, it is possible to suppress reductions in printing quality on the printing medium that are caused by cleaning of the destaticization section.

In the printing apparatus, it is preferable that the destaticization section has a ring shape, that the operation mechanism section includes an actuator, an operation driving roller that is connected to the actuator in a drivable manner, and an operation driven roller, that the destaticization section is wound around each of the corresponding rollers, and that the transport belt is disposed between each of the rollers in the definition direction.

In this case, when a driving force from the actuator of the operation mechanism section is transmitted to the operation driving roller, the destaticization section is operated. As a result of this, it is possible to change the location of the destaticization section that comes into contact with a printing medium, which is electrostatically adsorbed to the transport belt. In addition, by operating the destaticization section in this manner, it is possible to perform cleaning of the destaticization section at a position that is further on an outer side in the definition direction than the transport belt.

In the printing apparatus, it is preferable that the transport belt is configured to have an endless form, and that a printing medium, which is electrostatically adsorbed to an outer surface of the transport belt, is transported in the transport direction as a result of the transport belt being operated due to rotation of a transport driving roller, and it is preferable that the printing apparatus further includes a belt biasing member that biases a portion of the transport belt that faces the printing head toward a printing head side by coming into contact with an inner surface of the transport belt.

In this case, it becomes more difficult for transport defects of a printing medium to occur by an amount that is equivalent to an amount by which it becomes more difficult for the tension of the transport belt to become reduced. Accordingly, it is possible to suppress deteriorations in the printing quality that are caused by transport defects of a printing medium.

In the printing apparatus, it is preferable that the belt biasing member is configured by a conductive material, and is grounded.

In this case, it is possible to remove an electric charge with which an inner surface side of the transport belt is charged using the belt biasing member. As a result of this, it is possible to increase the size of the electrostatic adsorption force of a printing medium by the transport belt by an amount that is equivalent to an amount by which it becomes more difficult for the amount of the electric charge of an outer surface side of the transport belt to become reduced.

In the printing apparatus, it is preferable that the transport belt has a configuration in which an outer side thereof is formed using a conductive layer, and an inner side thereof is formed using an insulating layer with greater electrical resistance than the conductive layer, and it is preferable that an outer surface of the conductive layer is an outer surface of the transport belt, and an inner surface of the insulating layer is an inner surface of the transport belt.

In this case, since the outer surface of the transport belt is configured by a conductive layer with less electrical resistance than the insulating layer that configures the inner surface of the transport belt, it is possible to increase the size of the electrostatic adsorption force of a printing medium by the transport belt.

It is preferable that the printing apparatus further includes a destaticization control section that controls the operation mechanism section on the basis of a length in the width direction of a printing medium, which is a printing target, when the location of the destaticization section that comes into contact with a printing medium, which is electrostatically adsorbed to the transport belt, is changed.

In this case, when the location of the destaticization section that comes into contact with a printing medium, which is electrostatically adsorbed to the transport belt, is changed, it is possible to set an operation amount of the destaticization section depending on the length in the width direction of a printing medium, which is a printing target. Therefore, it is possible to suitably change the location of the destaticization section that comes into contact with a printing medium.

In the printing apparatus, it is preferable that the printing medium is supplied to a center in the width direction on the transport belt, and it is preferable that, in a case in which a sum of half of the length in the width direction of a printing medium, which is a printing target, and half of the transport belt in the width direction, is set as an exchange movement amount, the destaticization control section controls the operation mechanism section on the basis of the exchange movement amount when the location of the destaticization section that comes into contact with a printing medium, which is electrostatically adsorbed to the transport belt, is changed.

In this case, it is possible to set the operation amount of the destaticization section to a minimum limit when the location of the destaticization section that comes into contact with a printing medium, which is electrostatically adsorbed to the transport belt, is changed. As a result of this, it is possible to reduce an amount of time that is necessary for operation of the destaticization section, and furthermore, it is possible to improve the throughput of the printing apparatus.

In the printing apparatus, it is preferable that the printing medium is supplied to one end side in the width direction on the transport belt, and it is preferable that, in a case in which the length in the width direction of a printing medium, which is a printing target, is set as an exchange movement amount, the destaticization control section controls the operation mechanism section on the basis of the exchange movement amount when the location of the destaticization section that comes into contact with a printing medium, which is electrostatically adsorbed to the transport belt, is changed.

In this case, it is possible to set the operation amount of the destaticization section to a minimum limit when the location of the destaticization section that comes into contact with a printing medium, which is electrostatically adsorbed to the transport belt, is changed. As a result of this, it is possible to reduce an amount of time that is necessary for operation of the destaticization section, and furthermore, it is possible to improve the throughput of the printing apparatus.

In the printing apparatus, it is preferable that the destaticization control section changes the location of the destaticization section that comes into contact with a printing medium, which is electrostatically adsorbed to the transport belt, by controlling the operation mechanism section using the number of times of printing on the printing surface of a printing medium becoming equal to the number of times of moving as a trigger thereof.

In this case, it is possible to change the location of the destaticization section that comes into contact with a printing medium, which is electrostatically adsorbed to the transport belt, at regular intervals. Therefore, it is possible to achieve an increase in the longevity of the destaticization section.

It is preferable that the printing apparatus further includes a printing control section that carries out printing on a printing medium, which is electrostatically adsorbed to the transport belt, by operating the transport belt and controlling the printing head when a printing job is input, and it is preferable that the destaticization control section changes the location of the destaticization section that comes into contact with a printing medium, which is electrostatically adsorbed to the transport belt, by controlling the operation mechanism section when printing on a printing medium based on the printing job is completed, or when printing on a printing medium based on the printing job is initiated.

In this case, it is possible to make the location of the destaticization section that comes into contact with a printing medium, which is electrostatically adsorbed to the transport belt, differ during printing based on a new printing job, and during printing based on a previous printing job. By making the location of the destaticization section that comes into contact with a printing medium differ for each printing job in this manner, it is possible to achieve an increase in the longevity of the destaticization section.

In the printing apparatus, it is preferable that a plurality of printing modes, in which the resolution of an image that is formed on the printing surface of the printing medium differs, are prepared, and it is preferable that the destaticization control section changes the location of the destaticization section that comes into contact with a printing medium, which is electrostatically adsorbed to the transport belt, by controlling the operation mechanism section using the printing mode changing as a trigger thereof.

In this case, it is possible to suitably change the location of the destaticization section that comes into contact with a printing medium, which is electrostatically adsorbed to the transport belt. Therefore, it is possible to achieve an increase in the longevity of the destaticization section.

It is preferable that the printing apparatus further includes an electric charge amount sensor that is positioned between the destaticization section and the printing head in the transport direction, and that detects an amount of an electric charge that the printing surface of a printing medium, which is electrostatically adsorbed to the transport belt, is charged with, and it is preferable that the destaticization control section changes the location of the destaticization section that comes into contact with a printing medium, which is electrostatically adsorbed to the transport belt, by controlling the operation mechanism section when the amount of the electric charge that is detected by the electric charge amount sensor becomes greater than or equal to a movement electric charge amount up until before subsequent printing is initiated.

In this case, since it is possible to judge that the removal efficiency of an electric charge from the printing surface of a printing medium by the destaticization section is reduced when the amount of the electric charge that is detected by the electric charge amount sensor becomes greater than or equal to a movement electric charge amount, the location of the destaticization section that comes into contact with a printing medium is changed. As a result of this, it is possible to suppress reductions in the removal efficiency of an electric charge from a printing medium by the destaticization section.

It is preferable that the printing apparatus further includes a reversal mechanism that, after printing on a first surface of the two surfaces of a printing medium is completed, guides the printing medium onto the transport belt by reversing the top and bottom of the printing medium so that a second surface, which is a surface that is on an opposite side to the first surface, becomes the printing surface, and it is preferable that the destaticization control section changes the location of the destaticization section that comes into contact with a printing medium, which is electrostatically adsorbed to the transport belt, by controlling the operation mechanism section while a printing medium is being supplied onto the transport belt by the reversal mechanism.

In this case, it is possible to change the location of the destaticization section that comes into contact with a printing medium while the printing medium is being supplied onto the transport belt again after printing on the first surface thereof is completed. Therefore, it is possible to suppress reductions in the throughput of the printing apparatus by an amount that is equivalent to an amount by which it is not necessary to delay the initiation of printing on the second surface in order to operate the destaticization section.

In the printing apparatus, it is preferable that the cleaning section includes a cleaning member that performs cleaning of the destaticization section by coming into contact with the destaticization section, and a displacement mechanism section that causes the cleaning member to be displaced between a sweeping position at which the cleaning member is capable of coming into contact with the destaticization section, and a retreat position at which the cleaning member is not capable of coming into contact with the destaticization section.

In this case, in a case in which the destaticization section is operated in a state of coming into contact with the cleaning member, the longer the duration of the state of the cleaning member coming into contact with the destaticization section, the easier it is for the destaticization section to be subjected to damage. Further, the greater the extent of such damage, the more the removal efficiency of an electric charge from a printing medium by the destaticization section is reduced. Therefore, it is desirable that the cleaning member not come into contact with the destaticization section when cleaning of the destaticization section is not necessary. In such an instance, in the above-mentioned configuration, it is possible to cause the cleaning member to come into contact with the destaticization section, cause the cleaning member to become separated from the destaticization section, and the like, using the action of the displacement mechanism section. Therefore, it is possible to cause the cleaning member to be separated from the destaticization section at times other than when performing cleaning of the destaticization section. Accordingly, it is possible to make it difficult for the destaticization section to be subjected to damage, and furthermore, it is possible to suppress reductions in the removal efficiency of an electric charge from a printing medium by the destaticization section.

In the printing apparatus, it is preferable that the cleaning section performs cleaning of the destaticization section when maintenance of the printing head is being performed.

In this case, the cleaning member is made to come into contact with the destaticization section when maintenance of the printing head is being performed. Therefore, in comparison with a case of performing maintenance of the printing head and maintenance of the destaticization section at separate timings, it is possible to reduce an amount of time that is necessary for cleaning of the printing apparatus.

In the printing apparatus, it is preferable that the cleaning section performs cleaning of the destaticization section when the number of times of displacing the destaticization section, which is the number of times that the location of the destaticization section that comes into contact with a printing medium, which is electrostatically adsorbed to the transport belt, is changed, becomes the number of times of cleaning determination.

In this case, it is possible to judge that an amount of foreign matter that is adhered to the destaticization section is greater as the above-mentioned number of times of displacing the destaticization section increases. In such an instance, in the above-mentioned configuration, an implementation timing of cleaning of the destaticization section is decided on the basis of the above-mentioned number of times of displacing the destaticization section. As a result of this, by setting the number of times of cleaning determination to a suitable value, it is possible to perform cleaning of the destaticization section at a suitable timing.

It is preferable that the printing apparatus further includes an electric charge amount sensor that is positioned between the destaticization section and the printing head in the transport direction, and that detects an amount of an electric charge that the printing surface of a printing medium, which is electrostatically adsorbed to the transport belt, is charged with, and it is preferable that the cleaning section performs cleaning of the destaticization section when the amount of the electric charge that is detected by the electric charge amount sensor becomes greater than or equal to the cleaning determination electric charge.

In this case, since it is possible to judge that the removal efficiency of an electric charge from a printing medium by the destaticization section is reduced when the amount of the electric charge that is detected by the electric charge amount sensor becomes greater than or equal to the cleaning determination electric charge, cleaning of the destaticization section is executed. Therefore, it is possible to achieve optimization of the implementation timing of cleaning of the destaticization section, and furthermore, it is possible to suppress reductions in the removal efficiency of an electric charge from a printing medium by the destaticization section.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment in which a printing apparatus takes the form of an ink jet type printer, will be described in accordance with FIGS. 1 to 10.

Figure 1:
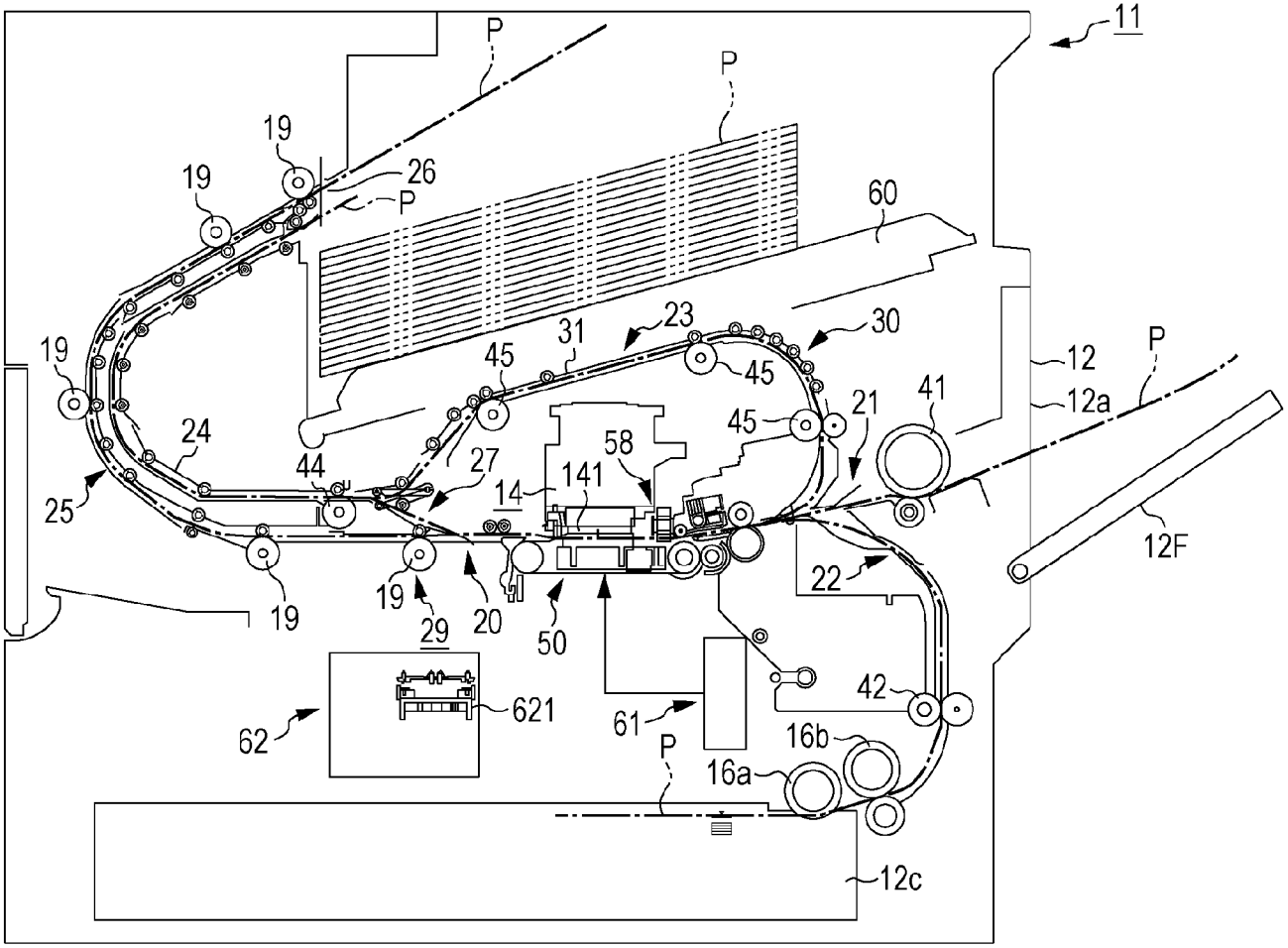
FIG. 1 is a side view that shows a schematic configuration of a printing apparatus.

As shown in FIG. 1, a transport device 29 that transports sheets of paper P, which are an example of a printing medium, along a medium transport path 20, and a printing unit 14 that carries out printing on sheets of paper P that are transported, are provided inside a housing 12 of a printing apparatus 11 the present embodiment. In a case in which a direction that is orthogonal a paper surface in FIG. 1 is set as a width direction of sheets of paper, the medium transport path 20 is formed so as to transport sheets of paper P in a direction that intersects the width direction of sheets of paper, and desirably a direction that is orthogonal to the width direction.

The printing unit 14 is provided with a line head type printing head 141 that is capable of discharging an ink, which is an example of a printing material, across substantially the entirety of the width direction of sheets of paper. Further, images are formed on sheets of paper P as a result of ink that is discharged from the printing head 141 adhering to the sheets of paper P.

The transport device 29 is provided with an ejection mechanism section 25 that ejects sheets of paper P, on which printing has been completed, to outside the housing 12, and a feeding mechanism section 30 that feeds sheets of paper P prior to printing along the medium transport path 20.

The ejection mechanism section 25 includes a plurality of ejection roller pairs 19 that are disposed along the medium transport path 20. Sheets of paper P that are transported by the ejection mechanism section 25 are ejected to outside the housing 12 from a medium ejection opening 26 that is formed in the housing 12. In other words, the medium ejection opening 26 is a downstream end of the medium transport path 20, that is, is most downstream in a transport pathway of media. Further, sheets of paper P that are ejected from the medium ejection opening 26 are mounted on a mounting platform 60 in a laminated state as shown by the two-dot chain line in FIG. 1.

The feeding mechanism section 30 includes a first medium supply section 21, a second medium supply section 22, a third medium supply section 23 and an electrostatic transport section 50. The electrostatic transport section 50 is disposed directly below the printing unit 14 in the drawing. That is, the ink is discharged from the printing head 141 onto sheets of paper P that are transported by the electrostatic transport section 50.

A cover 12F that is capable of opening and closing is provided on one side surface (the right side surface in FIG. 1) of the housing 12, and an insertion opening 12*a* is exposed as a result of the cover 12F being opened. The first medium supply section 21 is provided with a first feeding roller pair 41 that interposes sheets of paper P that are inserted into the housing 12 from the insertion opening 12*a*, which is exposed in this manner, therebetween. Further, sheets of paper P are supplied toward the electrostatic transport section 50 as a result of rotation of the two rollers that configure the first feeding roller pair 41.

In addition, a medium cassette 12*c*, in which sheets of paper P prior to printing are set in a laminated state, is provided in a lower section of the housing 12 in FIG. 1. The second medium supply section 22 is a supply member for feeding sheets of paper P from the medium cassette 12*c*. That is, the second medium supply section 22 is provided with a pick-up roller 16*a* that sends out a topmost sheet of paper P inside the medium cassette 12*c* to outside the medium cassette 12*c*, a separation roller pair 16*b* that suppresses a circumstance in which a plurality of sheets of paper P are transported in an overlapping manner, and a second feeding roller pair 42 that interposes a single sheet of paper P that passes through the separation roller pair 16*b*. Further, sheets of paper P are supplied toward the electrostatic transport section 50 as a result of rotation of the two rollers that configure the second feeding roller pair 42.

The third medium supply section 23 is a supply section for guiding sheets of paper P on which printing has been completed on a sheet surface (a first surface) of a single side thereof, to the electrostatic transport section 50 again when performing printing on both sides of a sheet surface on a sheet of paper P. That is, a branched transport path 24 that branches out from the medium transport path 20, is formed further downstream in the transport direction of sheets of paper than the electrostatic transport section 50. Further, a branching mechanism 27, which is disposed further downstream in the transport direction of sheets of paper than the electrostatic transport section 50 and which switches the transport pathway of sheets of paper P between the medium transport path 20 and the branched transport path 24, and a branching transport roller pair 44, which is disposed in the branched transport path 24 and of which rotation in both a normal and reverse directions is possible, are provided in the third medium supply section 23.

In a case of performing duplex printing, sheets of paper P on which printing has been completed on a sheet surface of a single side thereof, are guided from the electrostatic transport section 50 to the branched transport path 24 by the branching mechanism 27. At this time, sheets of paper P are transported downstream in the transport direction as a result of the rotation of each roller that configures the branching transport roller pair 44 in a normal direction. Further, when a rear end of a sheet of paper P is guided to the branched transport path 24, each roller that configures the branching transport roller pair 44 rotates in a reverse direction, and the sheet of paper P is transported in a reverse direction. When this happens, the sheet of paper P is guided to a reversal supply pathway 31 that is positioned above the printing unit 14 in FIG. 1. Further, the sheet of paper P is supplied along the reversal supply pathway 31 due to the rotation of a plurality of reversal transport roller pairs 45 that are disposed in the reversal supply pathway 31. As a result of this, the sheet of paper P converges with the medium transport path 20 at a position that is further upstream in the transport direction of sheets of paper than the electrostatic transport section 50. Thereafter, the corresponding sheet of paper P is guided to the electrostatic transport section 50 again.

When a sheet of paper P is guided to the electrostatic transport section 50 again in this manner, a sheet surface (a first surface) on which printing has been completed, comes into contact with the electrostatic transport section 50, and a sheet surface (a second surface) on which printing has not been performed, faces the printing head 141. Additionally, of the two surfaces of sheets of paper P, there are instances in which a sheet surface that comes into contact with the electrostatic transport section 50 is referred to as a "contact surface", and a surface that is on an opposite side to the contact surface is referred to as a "printing surface". That is, an example of a "reversal mechanism" that guides sheets of paper P to the electrostatic transport section 50 by reversing the top and bottom of the sheets of paper P using the third medium supply section 23 so that, after printing on a first surface of the two surfaces of sheets of paper P, the first surface becomes a contact surface and a second surface becomes a printing surface, is configured in the printing apparatus 11 of the present embodiment.

Figure 2:
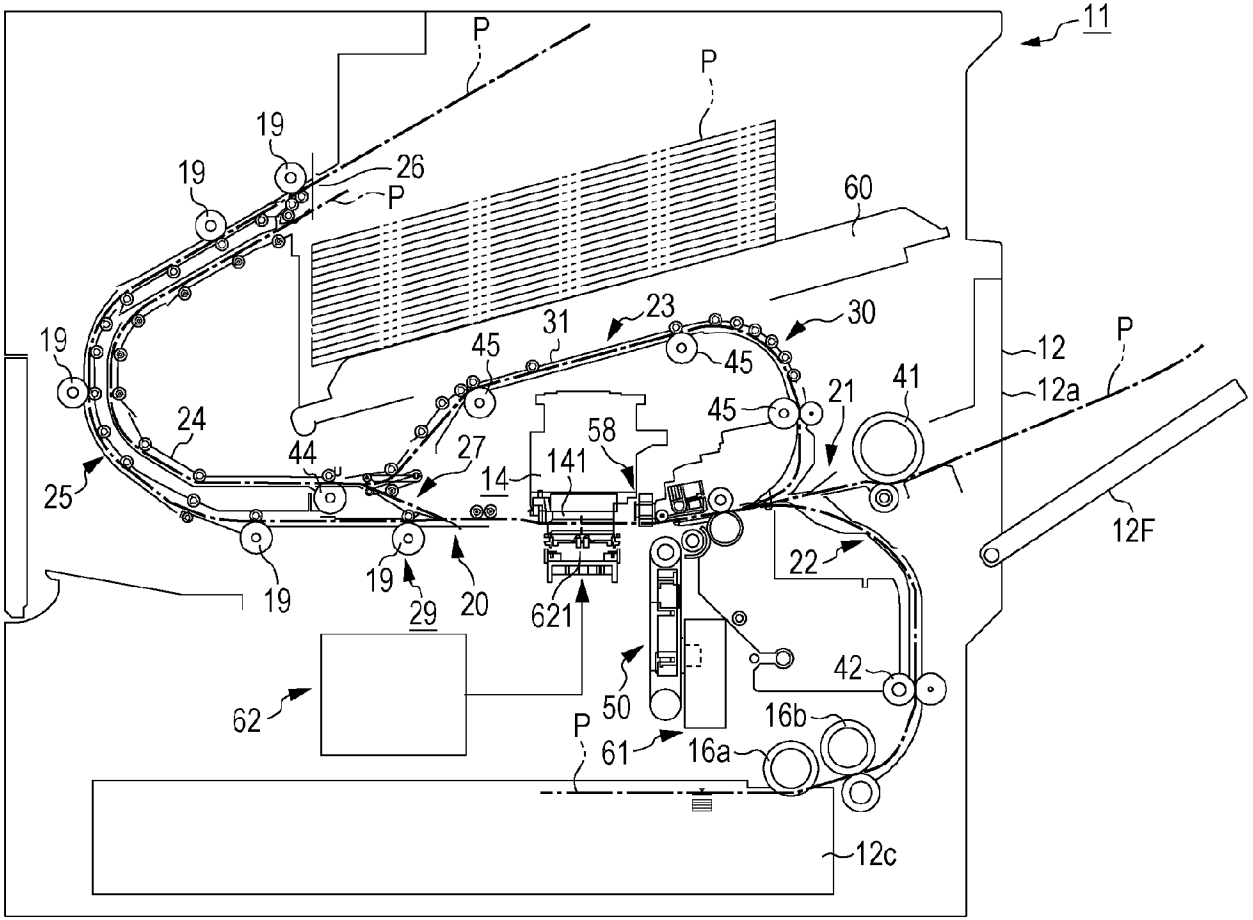
FIG. 2 is a side view that shows a schematic configuration of the printing apparatus.

Additionally, as shown in FIGS. 1 and 2, an electrostatic transport movement device 61 that moves the electrostatic transport section 50 between two positions of a transport position that is shown in FIG. 1 and a retreat position that is shown in FIG. 2, and a head maintenance device 62 for performing maintenance of the printing head 141, are provided in the printing apparatus 11 of the present embodiment. The head maintenance device 62 includes a maintenance section 621 that comes into contact with the printing head 141 when the electrostatic transport section 50 is positioned in the retreat position. Further, maintenance of the printing head 141 is performed by the head maintenance device 62 in a state in which the maintenance section 621 comes into contact with the printing head 141.

Next, the configuration of the electrostatic transport section 50 and the peripheral members thereof will be described with reference to FIG. 3.

Figure 3:
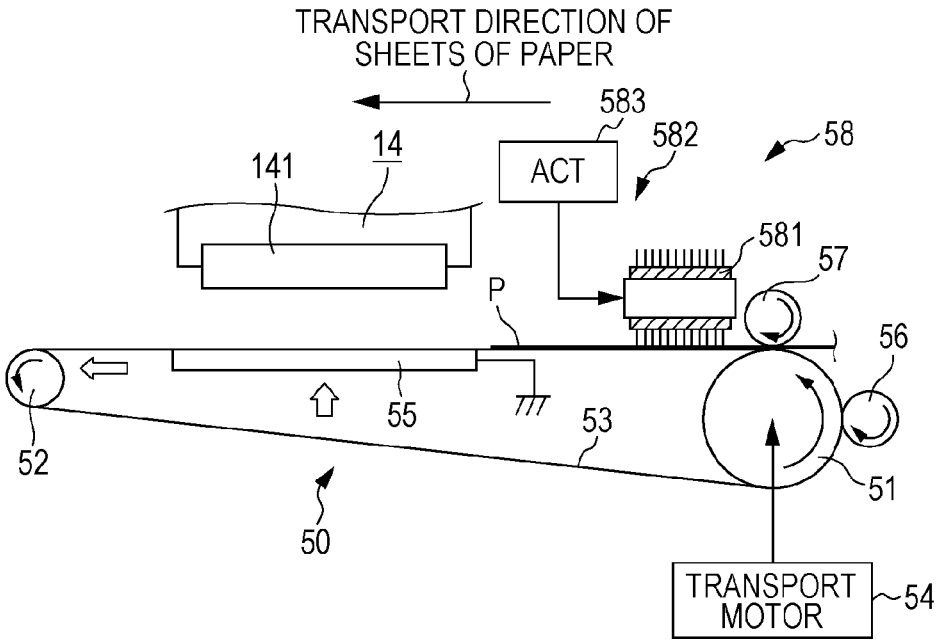
FIG. 3 is a schematic diagram that shows a configuration of an electrostatic transport section of the printing apparatus and peripheral members thereof.

As shown in FIG. 3, the electrostatic transport section 50 is provided with a transport driving roller 51 that is disposed further upstream in the transport direction of sheets of paper (that is, on the right side in the drawing) than the printing head 141, and a transport driven roller 52 that is disposed further downstream in the transport direction of sheets of paper (that is, on the left side in the drawing) than the printing head 141. In addition, a ring-shaped transport belt 53 that has an endless form is wound around these rollers 51 and 52. As shown by an arrow in FIG. 3, the transport driven roller 52 is biased toward a direction of becoming separated from the transport driving roller 51 (the left side in the drawing). Further, the transport belt 53 is operated, and sheets of paper P are transported downstream in the transport direction as a result of driving of a transport motor 54 being transmitted to the transport driving roller 51. That is, an outer surface of the transport belt 53 functions as a support surface that comes into contact with the contact surface of a sheet of paper P.

In addition, a metal backup plate 55 that supports sheets of paper P through the transport belt 53, is provided directly below the printing head 141. Additionally, the backup plate 55 is grounded. In addition, the backup plate 55 comes into contact with an inner surface of the transport belt 53, which is a surface that is on an opposite side to the support surface of the transport belt 53, and biases the transport belt 53 toward a printing head 141 side. Accordingly, an example of a "belt biasing member" that biases a portion of the transport belt 53 that faces the printing head 141 toward the printing head 141 side as a result of coming into contact with the inner surface of the transport belt 53 due to the backup plate 55, is configured in the printing apparatus 11 of the present embodiment.

In addition, a charging roller 56, which is an example of a charging section, is provided further upstream in the transport direction of sheets of paper (on the right side in the drawing) than the transport driving roller 51. The charging roller 56 comes into contact with the outer surface of the transport belt 53. Further, the charging roller 56 is driven to rotate by the transport driving roller 51 as a result of the rotation of the transport driving roller 51 being transmitted to the charging roller 56 through the transport belt 53. At this time, the charging roller 56 supplies an electric charge to a portion of the outer surface of the transport belt 53 that comes into contact with the charging roller 56. That is, the transport belt 53 is charged as a result of coming into contact with the charging roller 56. Additionally, in the printing apparatus 11 of the present embodiment, an AC voltage is applied to the charging roller 56, and a positive electric charge and a negative electric charge are alternately supplied to the transport belt 53 that comes into contact with the charging roller 56.

In addition, a support roller 57 that presses sheets of paper P that are fed to the electrostatic transport section 50 against the transport belt 53, is provided further upstream in the transport direction of sheets of paper (on the right side in the drawing) than the printing head 141. More specifically, the support roller 57 presses sheets of paper P against the charged transport belt 53. Such a support roller 57, is, for example, configured from a conductive material such as a metal, and is grounded. Further, the support roller 57 is driven to rotate by the transport driving roller 51 as a result of the rotation of the transport driving roller 51 being transmitted to the support roller 57 through the transport belt 53.

Furthermore, a destaticization device 58 is provided between the support roller 57 and the printing head 141 in the transport direction of sheets of paper. The destaticization device 58 is provided with a destaticization section 581 that is configured by a brush or the like, and an operation mechanism section 582 that operates the destaticization section 581 in order to change a location of the destaticization section 581 that comes into contact with a sheet of paper P or the transport belt 53. Further, when the destaticization section 581 comes into contact with the printing surface of a sheet of paper P that is transported by the transport belt 53, the destaticization section 581 removes an electric charge from the printing surface.

Next, the transport belt 53 will be described with reference to FIG. 4.

Figure 4:
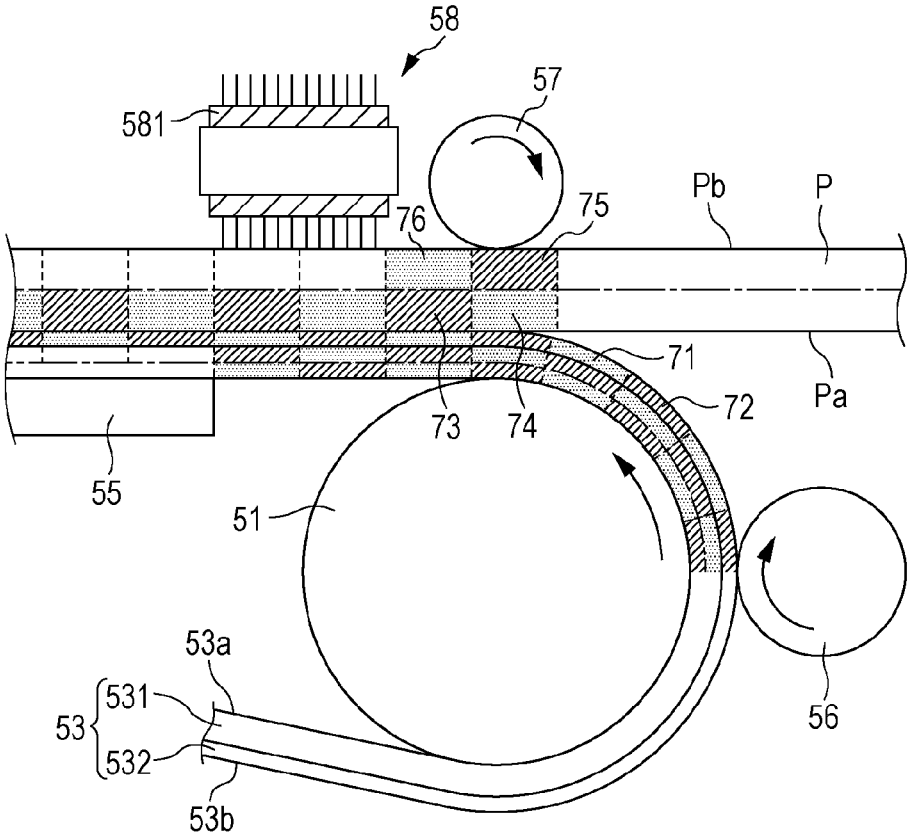
FIG. 4 is an action diagram that shows an aspect in which a transport belt is charged with an electric charge.

As shown in FIG. 4, the transport belt 53 includes an insulating layer 531 that has a ring form, and a ring-shaped conductive layer 532 that is formed on an outer side of the insulating layer 531. The conductive layer 532 is configured so the electrical resistance thereof is less than that of the insulating layer 531. Further, an inner surface of the insulating layer 531 is an inner surface **53*a* of the transport belt 53, and an outer surface of the conductive layer 532 is an outer surface 53*b* of the transport belt 53**.

When the transport belt 53 is operated as a result of rotation of the transport driving roller 51, positive portions 71, which are charged with a positive electric charge, and negative portions 72, which are charged with a negative electric charge, are alternately formed on an outer surface **53*b* side of the transport belt 53, that is, on the conductive layer 532, as a result of the charging roller 56 being driven to rotate. In addition, when an electric charge is supplied to the conductive layer 532 in this manner, polarization is generated inside the insulating layer 531 that is in close contact with the conductive layer 532**.

When polarization is generated inside the insulating layer 531 in this manner, there are cases in which the electric charge inside the conductive layer 532 is neutralized by the electric charge inside the insulating layer 531, and the amount of the electric charge inside the conductive layer 532 decreases. In this case, there is a concern that an electrostatic adsorption force of a sheet of paper P by the transport belt 53 will become smaller.

In such an instance, in the abovementioned manner, in the printing apparatus 11 of the present embodiment, the grounded backup plate 55 comes into contact with the inner surface **53*a* of the transport belt 53, that is, with the insulating layer 531. Therefore, the electric charge inside the insulating layer 531 is removed by the backup plate 55. Accordingly, in the transport belt 53, it is difficult for the electric charge inside the conductive layer 532 to become neutralized by the electric charge inside the insulating layer 531, and it is difficult for the amount of the electric charge inside the conductive layer 532** to decrease.

In addition, when a sheet of paper P is pressed against the outer surface 53*b* of such a transport belt 53 by the support roller 57, the sheet of paper P comes into close contact with the transport belt 53, and polarization is generated inside the sheet of paper P. That is, while portions on a contact surface Pa (the lower surface in the drawing) of the sheet of paper P that face the positive portions 71 of the transport belt 53 become negative portions 73, which are charged with a negative electric charge, portions on the contact surface Pa of the sheet of paper P that face the negative portions 72 of the transport belt 53 become positive portions 74, which are charged with a positive electric charge. Accordingly, the positive portions 74 and the negative portions 73 are also alternately formed on the contact surface Pa of the sheet of paper P.

Additionally, negative portions 75, which are charged with a negative electric charge, and positive portions 76, which are charged with a positive electric charge, are also alternately formed on a printing surface Pb of the sheet of paper P, which is on an opposite side to the contact surface Pa. Such an electric charge of the printing surface Pb is removed by the destaticization section 581 that comes into contact with the printing surface Pb. By removing an electric charge of a printing surface Pb side in this manner, decreases in the electric charge of the contact surface Pa are suppressed. As a result of this, reductions in an electrostatic adsorption force of the sheet of paper P by the transport belt 53, are suppressed.

A resistance value of a sheet of paper P becomes higher as humidity in an installation environment of the printing apparatus 11 falls, and as a result it becomes easier for an electric charge of the printing surface Pb side to remain. In such an instance, in a case in which the printing apparatus 11 is used in an environment with low humidity, if the destaticization device 58 is provided, an electric charge of the printing surface Pb side is removed and decreases in the electric charge of the contact surface Pa side are suppressed. As a result of this, reductions in an electrostatic adsorption force of the sheet of paper P by the transport belt 53, are suppressed.

Next, the destaticization device 58 will be described with reference to FIGS. 5 to 8.

Figure 5:
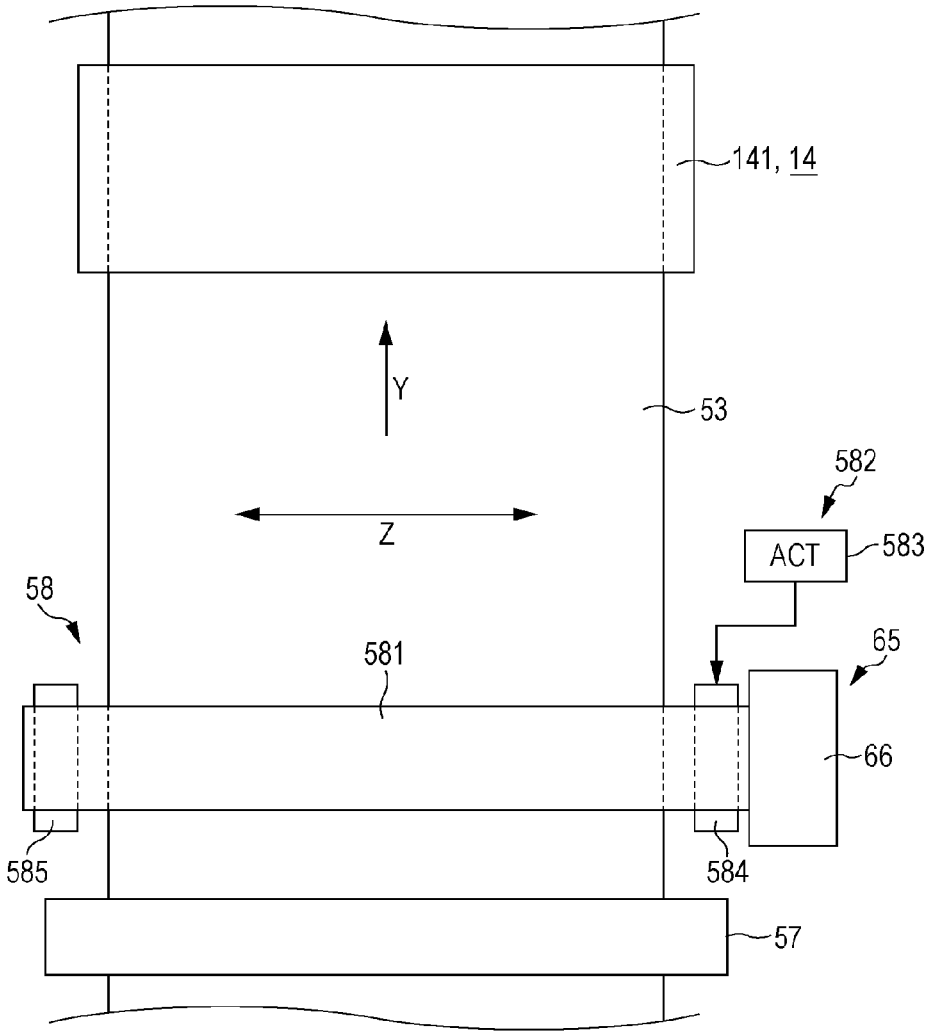
FIG. 5 is a schematic diagram of a case in which the transport belt and peripheral members thereof are viewed from above.
Figure 6:
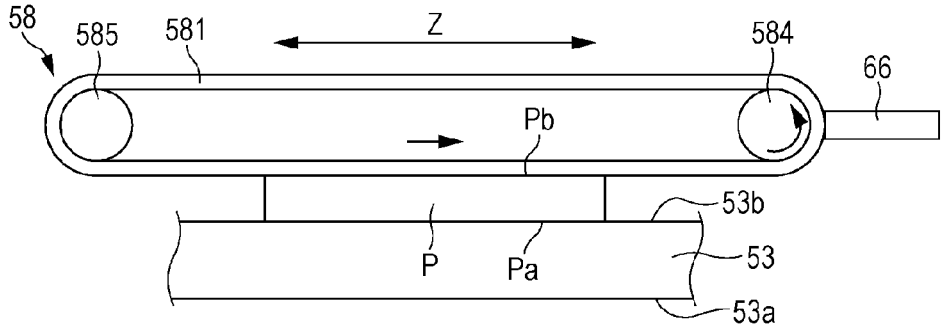
FIG. 6 is a side view that shows a schematic configuration of a destaticization device.

As shown in FIGS. 5 and 6, the operation mechanism section 582 of the destaticization device 58 is provided with an actuator 583, an operation driving roller 584 that is connected to the actuator 583 in a drivable manner, and an operation driven roller 585. The operation driving roller 584 is disposed further on one side in a width direction Z of sheets of paper than the transport belt 53 (that is, further on the right side than the transport belt 53 in FIG. 5), and the operation driven roller 585 is disposed further on the other side in the width direction Z of sheets of paper than the transport belt 53 (that is, further on the left side than the transport belt 53 in FIG. 5). In other words, the transport belt 53 is disposed between the rollers 584 and 585 in the width direction Z.

In addition, the destaticization section 581 of the destaticization device 58 has a form in which a brush protrudes out to an outer side from an endless belt. That is, the destaticization section 581 has a ring shape, and an electric charge is removed from the printing surface Pb as a result of the brush being pressed against the printing surface Pb of a sheet of paper P. Such a destaticization section 581 is wound around the operation driving roller 584 and the operation driven roller 585. Accordingly, one end of the destaticization section 581 in the width direction Z of sheets of paper is positioned further on an outer side in the width direction Z than one end of the transport belt 53, and the other end of the destaticization section 581 in the width direction Z is positioned further on an outer side in the width direction Z than the other end of the transport belt 53.

Further, when the operation driving roller 584 is rotated in the direction of the arrow in FIG. 6 as a result of driving of the actuator 583, the destaticization section 581 operates in the direction of the arrow in FIG. 6. When the destaticization section 581 is operated in this manner, it is possible to change the location of the destaticization section 581 that comes into contact with sheets of paper P, which are electrostatically adsorbed to the transport belt 53.

Additionally, the destaticization section 581 comes into contact with sheets of paper P that are electrostatically adsorbed to the transport belt 53 throughout the entire area of the width direction Z thereof. Therefore, the destaticization section 581 is disposed so as to extend in a definition direction, which is a direction that runs along the printing surface of sheets of paper P that are transported on the transport belt 53, and of which the width direction Z of sheets of paper P is the main component. Incidentally, the operation driving roller 584 and the operation driven roller 585 are disposed along the width direction Z of sheets of paper. Accordingly, in the printing apparatus 11 of the present embodiment, the above-mentioned definition direction coincides with the width direction Z of sheets of paper.

Given that, as a result of causing the destaticization section 581 to come into contact with sheets of paper P, foreign matter such as paper debris becomes adhered to the destaticization section 581, degradation of the destaticization section 581 itself proceeds, and the like. Further, as an amount of foreign matter that is adhered to the destaticization section 581 increases, degradation of the destaticization section 581 proceeds, and the like, the removal efficiency of an electric charge from sheets of paper P by the destaticization section 581 becomes reduced. In such an instance, in the printing apparatus 11 of the present embodiment, a location of the destaticization section 581 that comes into contact with sheets of paper P, is changed as appropriate.

Figure 7:
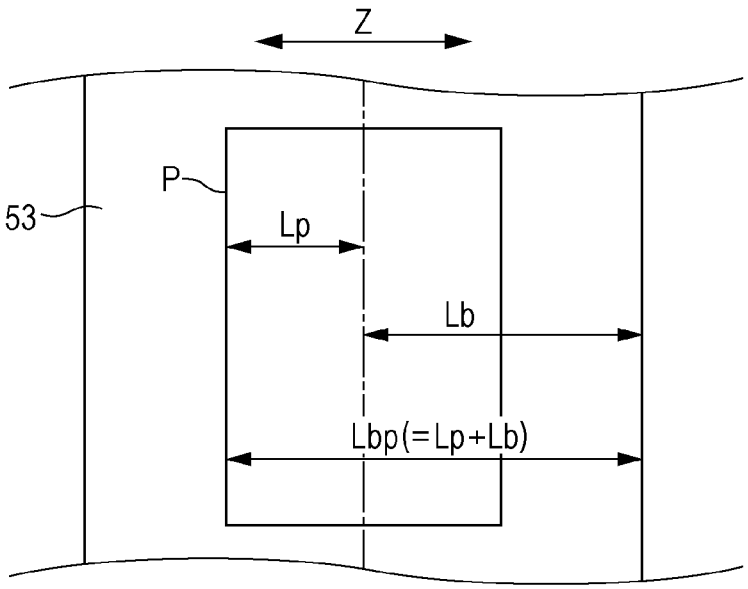
FIG. 7 is a schematic diagram that shows a case in which a sheet of paper is disposed in the center in the width direction of the transport belt.

In this instance, as shown in FIG. 7, in a case in which a sheet of paper P is guided to the center in the width direction of the transport belt 53, for example, it is possible to calculate an operation amount of the destaticization section 581 in the manner shown below. That is, in a case in which half of the length of the transport belt 53 in the width direction Z of sheets of paper is set as a belt length Lb, and half of the length of a sheet of paper P, which is a printing target, in the width direction Z is set as a paper sheet length Lp, the sum of the belt length Lb and the paper sheet length Lp (=Lb+Lp) is set as an exchange movement amount Lbp. Further, the operation amount is calculated according to the exchange movement amount Lbp. Therefore, the operation amount of the destaticization section 581 is greater than that of a case in which the length of a sheet of paper P, which is a printing target, in the width direction is long. Further, driving of the actuator 583 is controlled on the basis of the operation amount of the destaticization section 581. As a result of this, the location of the destaticization section 581 that comes into contact with the left end of the sheet of paper P in the drawing comes into contact with the right end of the transport belt 53 in the drawing as a result of driving of the actuator 583.

Figure 8:
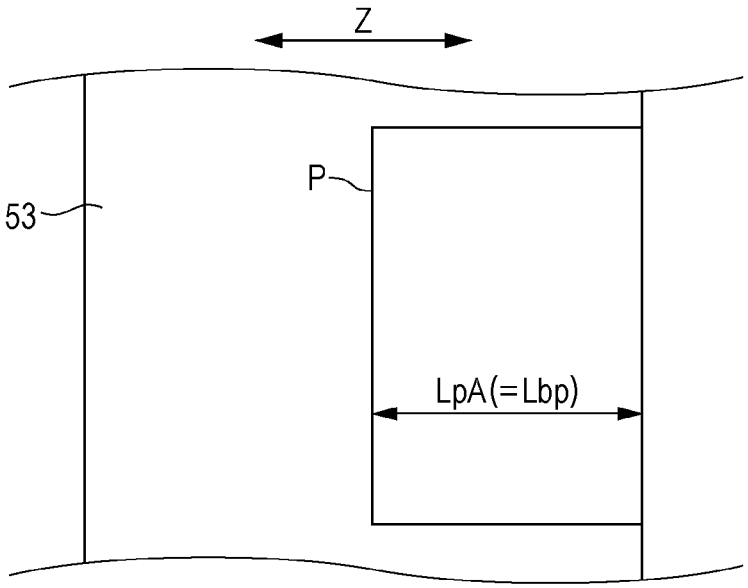
FIG. 8 is a schematic diagram that shows a case in which a sheet of paper is disposed at one end in the width direction of the transport belt.

In addition, as shown in FIG. 8, in a case in which a sheet of paper P is guided to one end in the width direction of the transport belt 53 (the right end in the drawing), for example, it is possible to calculate an operation amount of the destaticization section 581 in the manner shown below. That is, a paper sheet length LpA, which is a length of a sheet of paper P, which is a printing target, in the width direction, is set as the exchange movement amount Lbp. Further, the operation amount is calculated according to the exchange movement amount Lbp. Therefore, the operation amount of the destaticization section 581 is greater than that of a case in which the length of a sheet of paper P, which is a printing target, in the width direction is long. Further, driving of the actuator 583 is controlled on the basis of the operation amount of the destaticization section 581. As a result of this, the location of the destaticization section 581 that comes into contact with the left end of the sheet of paper P in the drawing comes into contact with the center of the sheet of paper P in the drawing as a result of driving of the actuator 583.

In addition, as shown in FIGS. 5 and 6, a cleaning section 65 that removes foreign matter from the destaticization section 581, is provided in the printing apparatus 11 of the present embodiment. The cleaning section 65 is disposed on an outer side of the transport belt 53 in the width direction Z of sheets of paper. Such a cleaning section 65 includes a cleaning member 66 that comes into contact with the destaticization section 581. In the printing apparatus 11 of the present embodiment, the cleaning member 66 normally comes into contact with the destaticization section 581 at a position that is on an outer side of the transport belt 53 in the width direction Z of sheets of paper. Therefore, foreign matter is removed from the destaticization section 581 by the cleaning member 66 as a result of the destaticization section 581 being operated due to driving of the operation driving roller 584. That is, an operation process for changing the location of the destaticization section 581 that comes into contact with a sheet of paper P, and cleaning of the destaticization section 581 by the cleaning member 66 are performed simultaneously.

Next, a control device 80 of the printing apparatus 11 will be described with reference to FIG. 9.

Figure 9:
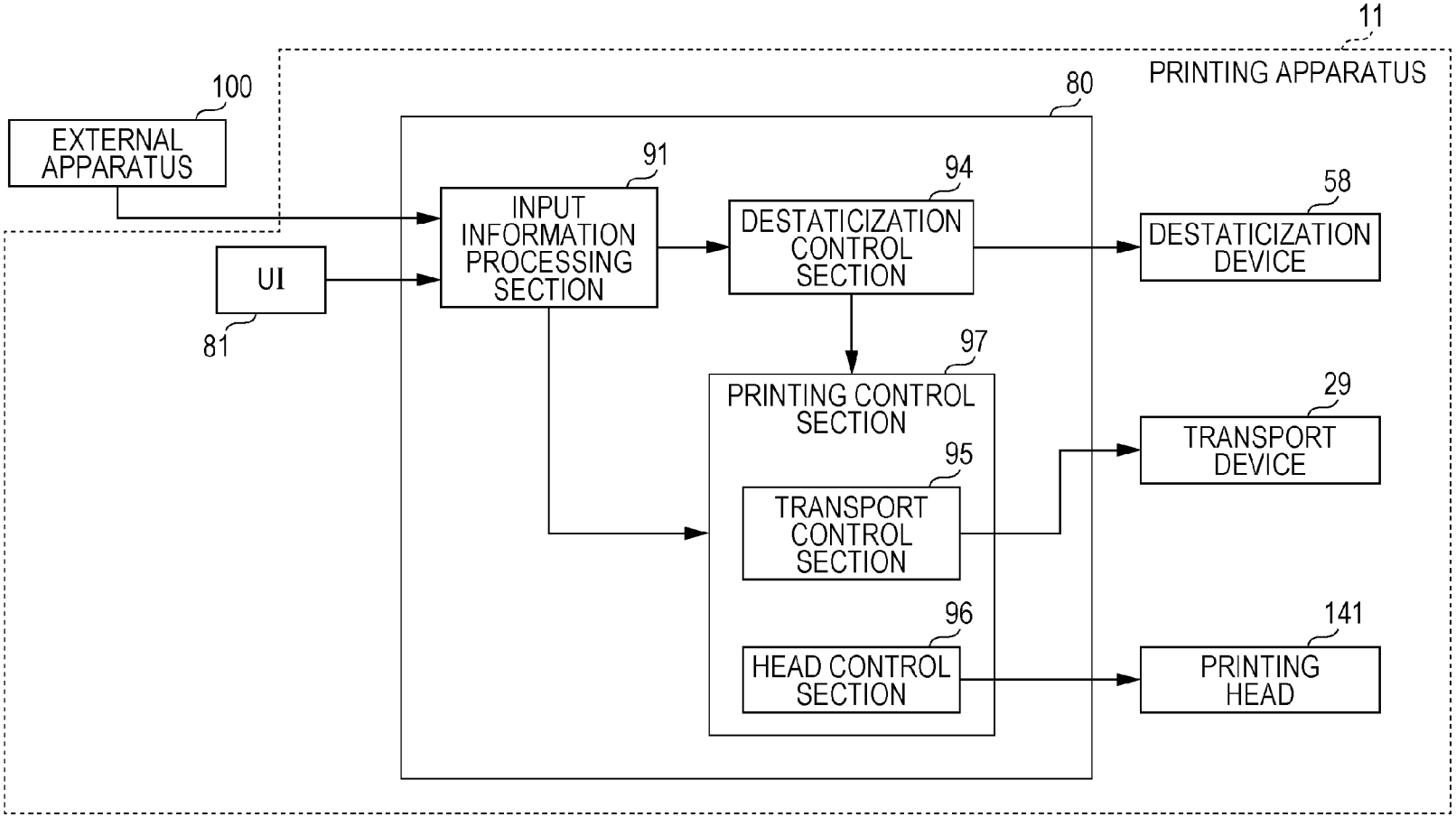
FIG. 9 is a block diagram that shows a functional configuration of the printing apparatus.

As shown in FIG. 9, a user interface 81, which is manipulated by a user, is electrically connected to the control device 80. In addition, an external apparatus 100 such as a personal computer or a mobile terminal is capable of communication with the control device 80.

Such a control device 80 is provided with a microcomputer that is configured by a CPU, ROM and RAM, an Application Specific IC (ASIC), and various driver circuits. Further, the control device 80 includes an input information processing section 91, a destaticization control section 94, and a printing control section 97 as functional sections that are configured by at least one of software and hardware.

The input information processing section 91 analyzes information that is input from the user interface 81 and information that is received from the external apparatus 100, and outputs analysis results thereof to the destaticization control section 94 and the printing control section 97 as appropriate. For example, the input information processing section 91 outputs information that relates to the number of times of printing, which is the number of times that printing is to be carried out on a sheet of paper P by a printing job that was input on this occasion, to the destaticization control section 94. In addition, the input information processing section 91 outputs information that relates to a transport state of a sheet of paper P, and information that relates to printing precision to the printing control section 97.

Additionally, for example, information that relates to a transport state of a sheet of paper P includes information that relates to a transport velocity of a sheet of paper P, information in which either one of single surface printing and duplex printing is selected, and the like. In addition, for example, information that relates to printing precision includes printing data, which is data that relates to an image to be formed on a sheet of paper P, information that relates to a resolution of an image to be formed on a printing surface of a sheet of paper P (that is, information that relates to a selected printing mode), and the like.

The destaticization control section 94 updates the number of times of printing N, which is the number of times that printing has been carried out on the printing surface Pb of a sheet of paper P on the basis of input information. The "number of times of printing N" that is referred to in this instance is the number of times that printing has been carried out on the printing surface Pb. Therefore, when performing single surface printing, the destaticization control section 94 increases the number of times of printing N in increments of "1" when printing on a single sheet of paper P is completed. In addition, when performing duplex printing, the destaticization control section 94 increases the number of times of printing N in increments of "2" when printing on a single sheet of paper P is completed.

In addition, when the updated number of times of printing N becomes greater than or equal to the number of times of moving Nth that is set in advance, the destaticization control section 94 implements an operation process that changes the location of the destaticization section 581 that comes into contact with a sheet of paper P, prior to printing on a subsequent sheet of paper P being initiated. The operation amount of the destaticization section 581 at this time is set as an amount that depends on the above-mentioned exchange movement amount Lbp. That is, the operation amount varies depending on the size of a sheet of paper P, which is a printing target. Further, when such an operation of the destaticization section 581 finishes, the destaticization control section 94 instructs for printing on the subsequent sheet of paper P.

In addition, in the printing apparatus 11 of the present embodiment, the destaticization control section 94 also implements the operation process while maintenance of the printing head 141 is being performed. When the operation process is implemented during implementation of the maintenance of the printing head 141 in this manner, the destaticization control section 94 resets the number of times of printing N to "0 (zero)".

The printing control section 97 includes a transport control section 95 and a head control section 96.

When the fact that the initiation of printing is permitted is input from the destaticization control section 94, the transport control section 95 controls the transport device 29 so that a sheet of paper P is transported in a state that is based on input information from the input information processing section 91.

The head control section 96 controls the state of ink discharge from the printing head 141 on the basis of printing data. At this time, the head control section 96 can form an image in a suitable position of the printing surface Pb of a sheet of paper P by cooperating with the transport control section 95.

Figure 10:
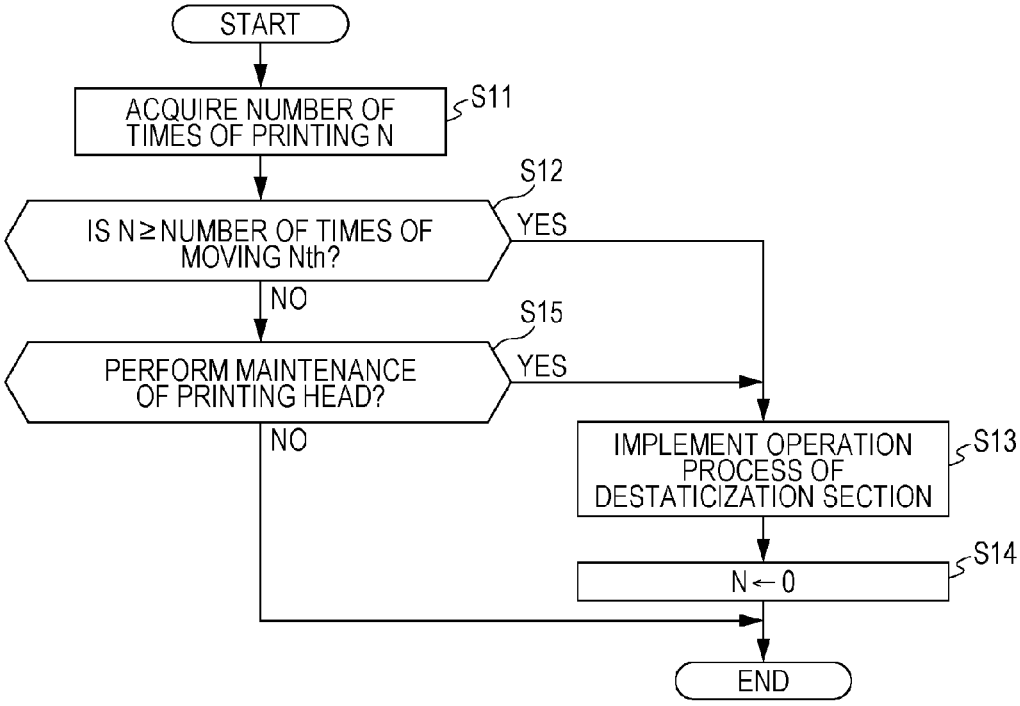
FIG. 10 is a flowchart that describes a process sequence when a destaticization section is operated in the printing apparatus.

Next, a process sequence when the destaticization section 581 is operated will be described with reference to the flowchart that is shown in FIG. 10. This process is executed when printing on a single sheet of paper P is completed.

As shown in FIG. 10, in Step S11, the number of times of printing N on the printing surface Pb is acquired. In Step S12, it is determined whether or not the acquired number of times of printing N is greater than or equal to the above-mentioned number of times of moving Nth. Further, in a case in which the number of times of printing N is greater than or equal to the number of times of moving Nth, it is possible to judge that the amount of foreign matter that is adhered to the location of the destaticization section 581 that comes into contact with a sheet of paper P is large.

Therefore, in a case in which the number of times of printing N is greater than or equal to the number of times of moving Nth (Step S12: YES), the process thereof migrates to the subsequent Step S13. Further, in Step S13, the operation process is implemented in order to change the location of the destaticization section 581 that comes into contact with a sheet of paper P. When the operation process is implemented, the destaticization section 581 can cause a location thereof that is different from a location that comes into contact with a sheet of paper P during previous printing to come into contact with a sheet of paper P. Further, when the operation process is finished, in Step S14, the number of times of printing N is reset to "0 (zero)", and thereafter, the present process is finished.

Meanwhile, in Step S12, in a case in which the number of times of printing N is less than the number of times of moving Nth (NO), the process migrates to the subsequent Step S15. Further, in Step S15, it is determined whether or not maintenance of the printing head 141 is being executed by the head maintenance device 62. In a case in which maintenance of the printing head 141 is being executed (Step S15: YES), the process migrates to Step S13, and the above-mentioned operation process of the destaticization section 581 is implemented. In this case, the destaticization section 581 is operated while maintenance of the printing head 141 is being performed. Further, when the operation process is finished, the process migrates to Step S14, the number of times of printing N is reset to "0 (zero)", and the present process is finished.

Meanwhile, in Step S15, in a case in which maintenance of the printing head 141 is not being performed (NO), the present process is finished without the operation process being implemented.

According to the abovementioned embodiment that has been described above, it is possible to obtain the following effects.

(1) By operating the destaticization section 581, it is possible to change the location of the destaticization section 581 that comes into contact with a sheet of paper P, which is electrostatically adsorbed to the transport belt 53. Further, when the destaticization section 581 is operated in this manner, cleaning of the destaticization section 581 using the cleaning member 66 is performed. Since such cleaning of the destaticization section 581 is performed at a position that is further on an outer side in the width direction Z of sheets of paper than the transport belt 53, it is difficult for phenomena such as foreign matter that is removed from the destaticization section 581 as a result of cleaning becoming adhered to a sheet of paper P again, the corresponding foreign matter becoming adhered to the printing head 141, which is positioned further on the downstream side in the transport direction of sheets of paper than the destaticization section 581, or the like, to occur. Additionally, when foreign matter becomes adhered to the printing head 141, there are cases in which the foreign matter gets inside the nozzles of the printing head 141, and causes blocking. In this case, there is a concern that discharge defects of the ink from the corresponding nozzles will occur. In the printing apparatus 11 of the present embodiment, it is difficult for such blocking of the nozzles to occur. Accordingly, it is possible to suppress reductions in printing quality on the sheets of paper P that are caused by cleaning of the destaticization section 581.

(2) The location of the transport belt 53 that faces the printing head 141 is biased toward the printing head 141 side by the backup plate 55. Therefore, it becomes more difficult for transport defects of sheets of paper P to occur by an amount that is equivalent to an amount by which it becomes more difficult for the tension of the transport belt 53 to become reduced. Accordingly, it is possible to suppress deteriorations in the printing quality that are caused by transport defects of sheets of paper P.

(3) In addition, since the backup plate 55 comes into contact with the inner surface 53*a* of the transport belt 53, it is possible to remove an electric charge that the inner surface side of the transport belt 53 is charged with using the backup plate 55. As a result of this, it is possible to increase the size of the electrostatic adsorption force of sheets of paper P by the transport belt 53 by an amount that is equivalent to an amount by which it becomes more difficult for the amount of the electric charge of the outer surface side of the transport belt 53 to become reduced.

(4) The outer surface 53*b* of the transport belt 53 is configured by the conductive layer 532, the electrical resistance of which is lower than that of the insulating layer 531 that configures the inner surface 53*a* of the transport belt 53. Therefore, it is possible to increase the size of the electrostatic adsorption force of sheets of paper P by the transport belt 53.

(5) The operation amount of the destaticization section 581 in the operation process is set as a value that depends on the above-mentioned exchange movement amount Lbp. Therefore, since the operation amount of the destaticization section 581 varies depending on the size of a sheet of paper P, which is a printing target, it is possible to set the operation amount of the destaticization section 581 to a minimum limit when changing the location of the destaticization section 581 that comes into contact with a sheet of paper P, which is electrostatically adsorbed to the transport belt 53. As a result of this, it is possible to reduce an amount of time that is necessary for operation of the destaticization section 581, and furthermore, it is possible to improve the throughput of the printing apparatus 11.

(6) Further, in the printing apparatus 11 of the present embodiment, since it is possible to judge that the adherence amount of foreign matter to the location of the destaticization section 581 that comes into contact with a sheet of paper is large when the number of times of printing N becomes greater than or equal to the number of times of moving Nth, the above-mentioned operation process is implemented before printing on a subsequent sheet of paper P is initiated. By changing the location of the destaticization section 581 that comes into contact with a sheet of paper P at regular intervals in this manner, it is possible to uniformly make use of the entire area of the destaticization section 581. Accordingly, in comparison with a case in which a portion of the destaticization section 581 is used intensively, it is possible to achieve an increase in the longevity of the destaticization section 581.

(7) In the printing apparatus 11 of the present embodiment, the above-mentioned operation process is implemented while maintenance of the printing head 141 is being performed. Therefore, it is possible to reduce the number of times that printing is temperature suspended in order to perform the above-mentioned operation process. Accordingly, it is possible to suppress deteriorations in the throughput of the printing apparatus 11.

Second Embodiment

Next, a second embodiment in which the printing apparatus 11 is given a specific form, will be described in accordance with FIG. 11. Additionally, in the second embodiment, the timing with which the operation process is implemented differs from that of the first embodiment. Accordingly, in the following description, description will be given focusing on portions that differ from the first embodiment, the same reference numerals will be given to member configurations that are the same as those of the first embodiment, and overlapping descriptions thereof will be omitted.

Figure 11:
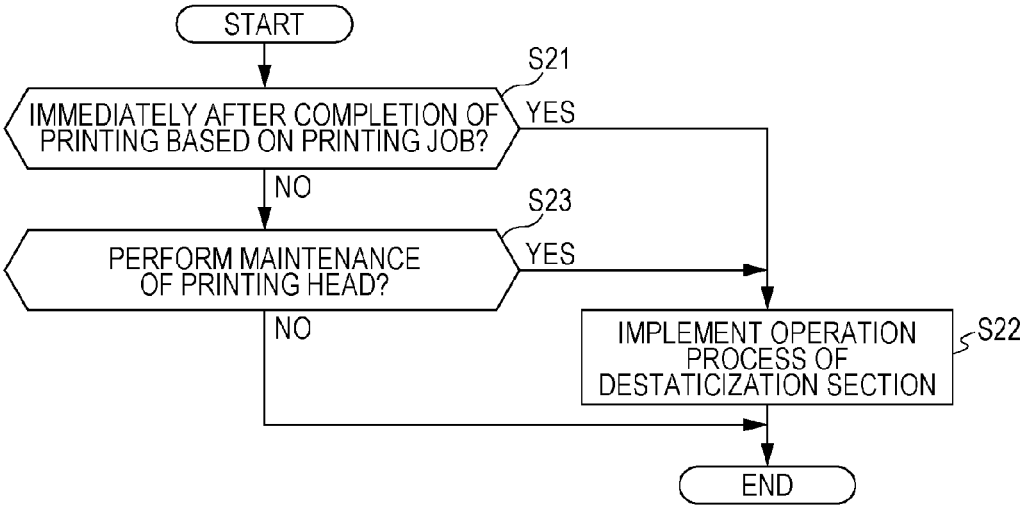
FIG. 11 is a flowchart that describes a process sequence when a destaticization section is operated in a printing apparatus of a second embodiment.

A process sequence when the destaticization section 581 is operated will be described with reference to the flowchart that is shown in FIG. 11.

As shown in FIG. 11, in Step S21, it is determined whether or not it is immediately after printing based on a single printing job has been completed. Further, in a case in which it is immediately after the completion of printing (Step S21: YES), the process thereof migrates to the subsequent Step S22. Further, in Step S22, the operation process is implemented in order to change the location of the destaticization section 581 that comes into contact with a sheet of paper P. Further, when the operation process is finished, the present process is finished.

Meanwhile, in Step S21, in a case in which it is not immediately after printing based on a single printing job has been completed (NO), the process thereof migrates to the subsequent Step S23. Further, in Step S23, it is determined whether or not maintenance of the printing head 141 is being executed by the head maintenance device 62. In a case in which maintenance of the printing head 141 is being executed (Step S23: YES), the process migrates to Step S22, and the above-mentioned operation process of the destaticization section 581 is implemented. In this case, the destaticization section 581 is operated while maintenance of the printing head 141 is being performed. Further, when the operation process is finished, the present process is finished. Meanwhile, in Step S23, in a case in which maintenance of the printing head 141 is not being performed (NO), the present process is finished without the operation process being implemented.

According to the printing apparatus 11 of the present embodiment that has been described above, in addition to the same effects as effects (1) to (5) and (7) in the above-mentioned first embodiment, it is possible to further obtain the following effect.

(8) In the printing apparatus 11 of the present embodiment, it is possible to make the location of the destaticization section 581 that comes into contact with a sheet of paper P, which is electrostatically adsorbed to the transport belt 53, differ during printing based on a new printing job, and during printing based on a previous printing job. By making the location of the destaticization section 581 that comes into contact with a sheet of paper P differ for each printing job in this manner, it is possible to uniformly make use of the entire area of the destaticization section 581. Accordingly, in comparison with a case in which a portion of the destaticization section 581 is used intensively, it is possible to achieve an increase in the longevity of the destaticization section 581.

Third Embodiment

Next, a third embodiment in which the printing apparatus 11 is given a specific form, will be described in accordance with FIG. 12. Additionally, in the third embodiment, the timing with which the operation process is implemented differs from that of each embodiment of the first and second embodiments. Accordingly, in the following description, description will be given focusing on portions that differ from each embodiment of the first and second embodiments, the same reference numerals will be given to member configurations that are the same as those of each embodiment of the first and second embodiments, and overlapping descriptions thereof will be omitted.

In the printing apparatus 11 of the present embodiment, a plurality of printing modes, in which the resolution of an image that is formed on the printing surface Pb of sheets of paper P differs, are prepared. For example, a first printing mode is a mode for forming a high resolution image on the printing surface Pb by prioritizing printing quality over printing velocity. In addition, a second printing mode is a mode for forming a low resolution image on the printing surface Pb by prioritizing printing velocity while retaining the printing quality at a certain level. Further, in the printing apparatus 11 of the present embodiment, the operation process of the destaticization section 581 is implemented when printing with a printing mode that differs from a printing mode up until a previous time, is initiated.

Figure 12:
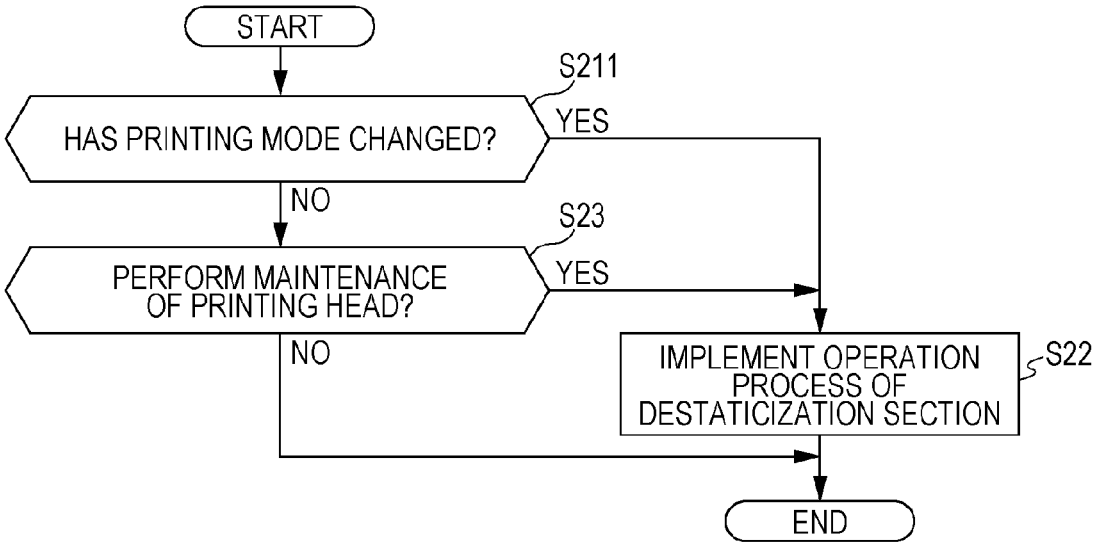
FIG. 12 is a flowchart that describes a process sequence when a destaticization section is operated in a printing apparatus of a third embodiment.

Next, a process sequence when the destaticization section 581 is operated will be described with reference to the flowchart that is shown in FIG. 12. The process is executed when printing is initiated.

As shown in FIG. 12, in Step S211, it is determined whether or not the printing mode has been changed. In a case in which the printing mode has been changed (Step S211: YES), the process thereof migrates to the subsequent Step S22. Further, in Step S22, the operation process is implemented in order to change the location of the destaticization section 581 that comes into contact with a sheet of paper P. Further, when the operation process is finished, the present process is finished.

Meanwhile, in Step S211, in a case in which printing mode has not been changed (NO), the process migrates to the subsequent Step S23. Further, in Step S23, it is determined whether or not maintenance of the printing head 141 is being executed by the head maintenance device 62. In a case in which maintenance of the printing head 141 is being executed (Step S23: YES), the process migrates to Step S22, and the above-mentioned operation process of the destaticization section 581 is implemented. In this case, the destaticization section 581 is operated while maintenance of the printing head 141 is being performed. Further, when the operation process is finished, the present process is finished. Meanwhile, in Step S23, in a case in which maintenance of the printing head 141 is not being performed (NO), the present process is finished without the operation process being implemented.

According to the printing apparatus 11 of the present embodiment that has been described above, in addition to the same effects as effects (1) to (5) and (7) in each embodiment of the above-mentioned first and second embodiments, it is possible to further obtain the following effect.

(9) In the printing apparatus 11 of the present embodiment, the location of the destaticization section 581 that comes into contact with a sheet of paper P, which is electrostatically adsorbed to the transport belt 53, is changed when printing is performed after changing the printing mode. By making the location of the destaticization section 581 that comes into contact with a sheet of paper P differ each time the printing mode is changed in this manner, it is possible to uniformly make use of the entire area of the destaticization section 581. Accordingly, in comparison with a case in which a portion of the destaticization section 581 is used intensively, it is possible to achieve an increase in the longevity of the destaticization section 581.

Fourth Embodiment

Next, a fourth embodiment in which the printing apparatus 11 is given a specific form, will be described in accordance with FIGS. 13 and 14. Additionally, in the fourth embodiment, the timing with which the operation process is implemented differs from that of each embodiment of the first to third embodiments. Accordingly, in the following description, description will be given focusing on portions that differ from each embodiment of the first to third embodiments, the same reference numerals will be given to member configurations that are the same as those of each embodiment of the first to third embodiments, and overlapping descriptions thereof will be omitted.

Figure 13:
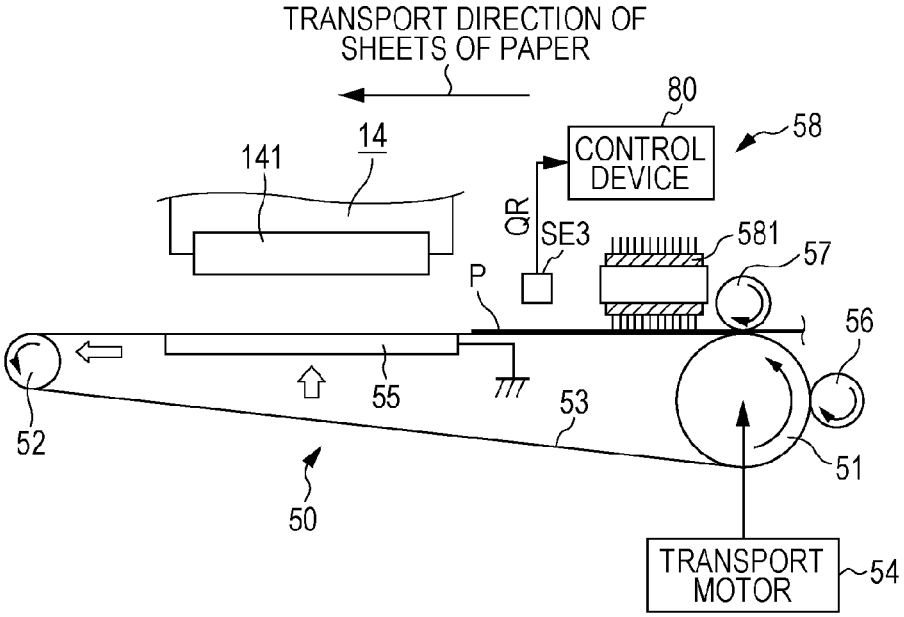
FIG. 13 is a side view that schematically shows a transport belt and the peripheral members thereof in a printing apparatus of a fourth embodiment.

As shown in FIG. 13, an electric charge amount sensor SE3 that is positioned between the destaticization section 581 and the printing head 141 in the transport direction of sheets of paper, and that detects an electric charge amount QR that the printing surface Pb of a sheet of paper P is charged with, is provided in the printing apparatus 11 of the present embodiment. That is, the electric charge amount QR of the printing surface Pb after the destaticization section 581 is passed through, is monitored. Further, when the electric charge amount QR is low, it is possible to judge that it is not possible to sufficiently remove an electric charge from a sheet of paper P using the destaticization section 581. Meanwhile, when the electric charge amount QR is high, it is possible to judge that the removal efficiency of an electric charge from a sheet of paper P by the destaticization section 581 is reduced.

When the removal efficiency of an electric charge from a sheet of paper P by the destaticization section 581 is reduced, it is desirable to change the location of the destaticization section 581 that comes into contact with a sheet of paper P, which is electrostatically adsorbed to the transport belt 53.

Figure 14:
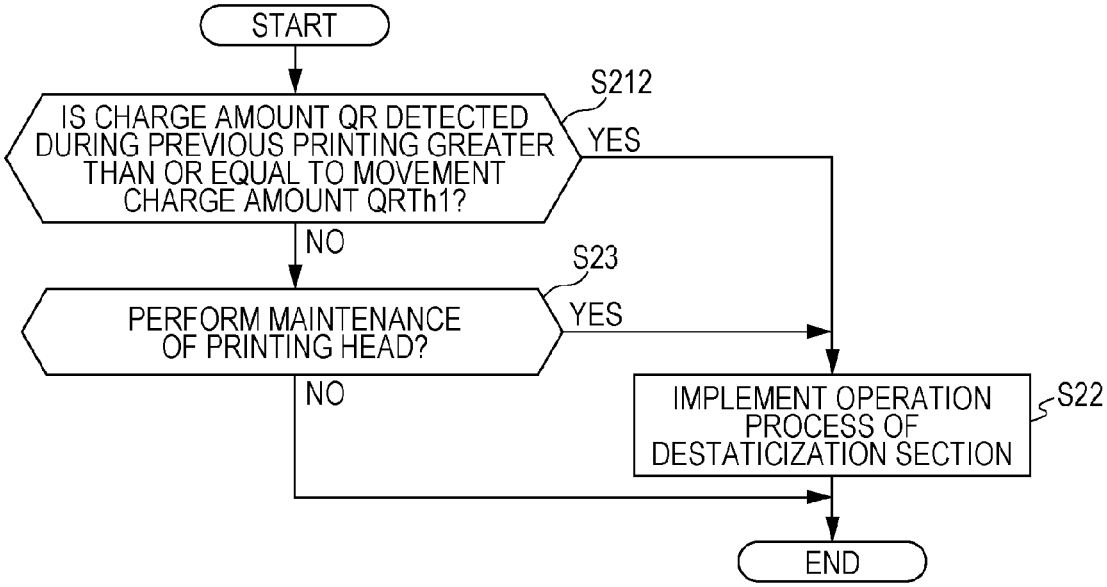
FIG. 14 is a flowchart that describes a process sequence when a destaticization section is operated in the printing apparatus of the fourth embodiment.

Next, a process sequence when the destaticization section 581 is operated will be described with reference to the flowchart that is shown in FIG. 14.

As shown in FIG. 14, in Step S212, it is determined whether or not the electric charge amount QR that was detected during a previous printing was greater than or equal to a movement electric charge amount QRTh1. In a case in which the electric charge amount QR is greater than or equal to the movement electric charge amount QRTh1 (Step S212: YES), since it is possible to judge that the removal efficiency of an electric charge from a sheet of paper P by the destaticization section 581 is reduced, the process thereof migrates to the subsequent Step S22. Further, in Step S22, the operation process is implemented in order to change the location of the destaticization section 581 that comes into contact with a sheet of paper P. Further, when the operation process is finished, the present process is finished.

Meanwhile, in Step S212, in a case in which the electric charge amount QR that was detected during a previous printing is less than the movement electric charge amount QRTh1 (NO), since it is possible to judge that the removal efficiency of an electric charge from a sheet of paper P by the destaticization section 581 is not reduced, the process thereof migrates to the subsequent Step S23. Further, in Step S23, it is determined whether or not maintenance of the printing head 141 is being executed by the head maintenance device 62. In a case in which maintenance of the printing head 141 is being executed (Step S23: YES), the process migrates to Step S22, and the above-mentioned operation process of the destaticization section 581 is implemented. In this case, the destaticization section 581 is operated while maintenance of the printing head 141 is being performed. Further, when the operation process is finished, the present process is finished. Meanwhile, in Step S23, in a case in which maintenance of the printing head 141 is not being performed (NO), the present process is finished without the operation process being implemented.

According to the printing apparatus 11 of the present embodiment that has been described above, in addition to the same effects as effects (1) to (5) and (7) in each embodiment of the above-mentioned first to third embodiments, it is possible to further obtain the following effect.

(10) In the printing apparatus 11 of the present embodiment, the removal efficiency of an electric charge from a sheet of paper P using the destaticization section 581 is measured in a practical sense, and when it is possible to judge that the efficiency is reduced, it is possible to change the location of the destaticization section 581 that comes into contact with the sheet of paper P, which is electrostatically adsorbed to the transport belt 53, as appropriate. As a result of this, reductions in the removal efficiency of an electric charge from sheets of paper P using the destaticization section 581, are suppressed, and therefore, it is possible to suppress reductions in the electrostatic adsorption force of sheets of paper P to the transport belt 53.

Fifth Embodiment

Next, a fifth embodiment in which the printing apparatus 11 is given a specific form, will be described in accordance with FIG. 15. Additionally, in the fifth embodiment, the timing with which the operation process is implemented differs from that of each embodiment of the first to fourth embodiments. Accordingly, in the following description, description will be given focusing on portions that differ from each embodiment of the first to fourth embodiments, the same reference numerals will be given to member configurations that are the same as those of each embodiment of the first to fourth embodiments, and overlapping descriptions thereof will be omitted.

In a case of performing duplex printing on a sheet of paper P, it is possible to refer to a period from a time point at which printing on the first surface is completed and the sheet of paper P is handed over from the transport belt 53 to the third medium supply section 23, up to a time point at which the sheet of paper P is supplied onto the transport belt 53 again by the third medium supply section 23, as a period in which the sheet of paper P is not on the transport belt 53. In such an instance, in the printing apparatus 11 of the present embodiment, the operation process of the destaticization section 581 is implemented in such a period.

Figure 15:
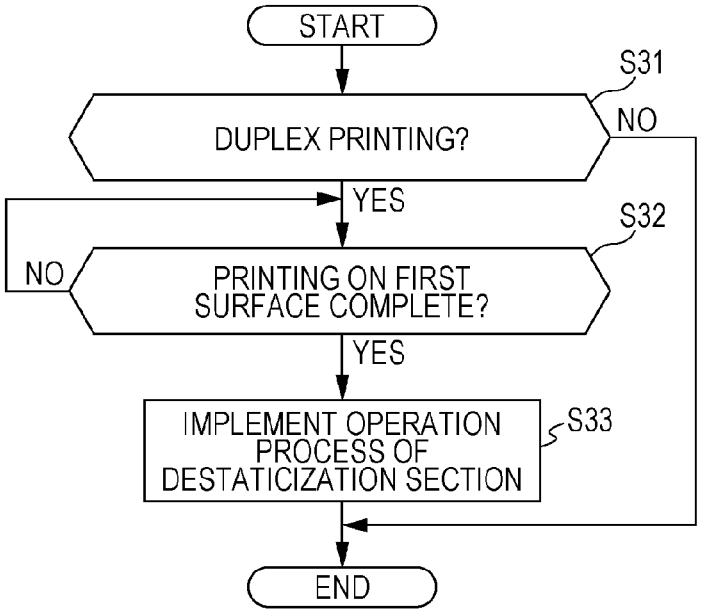
FIG. 15 is a flowchart that describes a process sequence when a destaticization section is operated in a printing apparatus of a fifth embodiment.

Next, a process sequence when the destaticization section 581 is operated will be described with reference to the flowchart that is shown in FIG. 15.

As shown in FIG. 15, in Step S31, it is determined whether or not the current printing is duplex printing. In a case in which the current printing is not duplex printing (Step S31: NO), the present process is finished without the operation process of the destaticization section 581 being implemented. Meanwhile, in a case in which the current printing is duplex printing (Step S31: YES), the process thereof migrates to the subsequent Step S32.

In Step S32, it is determined whether or not printing on the first surface is complete. In a case in which printing on the first surface is not yet complete (Step S32: NO), printing on the first surface is continued. Meanwhile, in a case in which printing on the first surface is complete (Step S32: YES), the process thereof migrates to the subsequent Step S33. In Step S33, the operation process is implemented in order to change the location of the destaticization section 581 that comes into contact with a sheet of paper P. Further, when the operation process is finished, the present process is finished.

According to the printing apparatus 11 of the present embodiment that has been described above, in addition to the same effects as effects (1) to (5) and (7) in each embodiment of the above-mentioned first to fourth embodiments, it is possible to further obtain the following effect.

(11) In the printing apparatus 11 of the present embodiment, it is possible to change the location of the destaticization section 581 that comes into contact with a sheet of paper P during a period after printing on the first surface is completed and a sheet of paper P is supplied onto the transport belt 53 again, that is, during a period in which the sheet of paper P is not on the transport belt 53. Therefore, it is possible to suppress reductions in the throughput of the printing apparatus 11 by an amount that is equivalent to an amount by which it is not necessary to delay the initiation of printing on the second surface in order to operate the destaticization section 581.

Sixth Embodiment

Next, a sixth embodiment in which the printing apparatus 11 is given a specific form, will be described in accordance with FIGS. 16 and 17. Additionally, in the sixth embodiment, a feature of the cleaning section being moveable is different from each embodiment of the first to fifth embodiments. Accordingly, in the following description, description will be given focusing on portions that differ from each embodiment of the first to fifth embodiments, the same reference numerals will be given to member configurations that are the same as those of each embodiment of the first to fifth embodiments, and overlapping descriptions thereof will be omitted.

Figure 16:
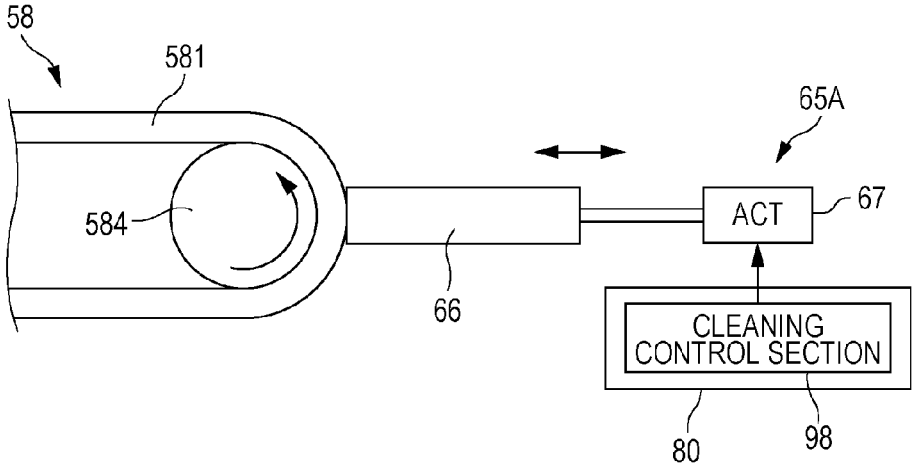
FIG. 16 is a side view that schematically shows a cleaning section in a printing apparatus of a sixth embodiment.

As shown in FIG. 16, a cleaning section 65A is provided with the cleaning member 66, and a displacement mechanism section 67 that causes the cleaning member 66 to be displaced between a sweeping position at which the cleaning member 66 is capable of coming into contact with the destaticization section 581, and a retreat position at which the cleaning member 66 is not capable of coming into contact with the destaticization section 581. The control of such a displacement mechanism section 67 is performed by a cleaning control section 98 of the control device 80. Further, in a case in which the cleaning member 66 is disposed in the sweeping position due to action of the displacement mechanism section 67, the cleaning member 66 comes into contact with the destaticization section 581 at a position that is further on an outer side in the width direction Z of sheets of paper than the transport belt 53. Cleaning of the destaticization section 581 is performed by the cleaning member 66 as a result of operating the destaticization section 581 in this state.

In addition, in a case in which the cleaning member 66 is fixed in the sweeping position in the manner described in each of the above-mentioned embodiments, when the destaticization section 581 is operated, cleaning of the destaticization section 581 by the cleaning member 66 is implemented. In contrast to this, in the printing apparatus 11 of the present embodiment, by disposing the cleaning member 66 in the retreat position as a result of the action of the displacement mechanism section 67, it is possible to set so that cleaning of the destaticization section 581 by the cleaning member 66 is not implemented even in a case in which the destaticization section 581 is operated.

Further, in the printing apparatus 11 of the present embodiment, the number of times of displacing the destaticization section M, which is a number of executions of the operation process of the destaticization section 581, is counted, and an implementation timing of cleaning of the destaticization section 581 is decided on the basis of the number of times of displacing the destaticization section M.

In addition, when the electric charge amount QR that is detected by the electric charge amount sensor SE3 is high, it is possible to judge that the removal efficiency of an electric charge from a sheet of paper P by the destaticization section 581 is reduced. In such an instance, in the printing apparatus 11 of the present embodiment, an implementation timing of cleaning of the destaticization section 581 is also decided on the basis of the electric charge amount QR.

Figure 17:
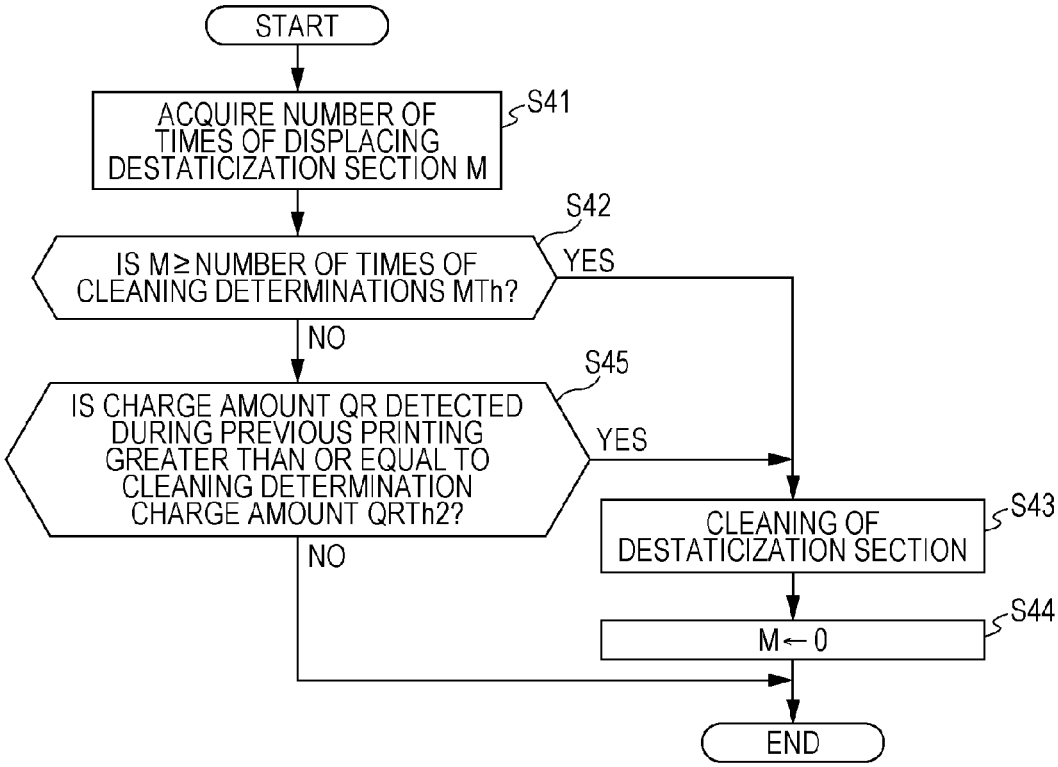
FIG. 17 is a flowchart that describes a process sequence when cleaning of a destaticization section implemented in the printing apparatus of the sixth embodiment.

Next, a process sequence when cleaning of the destaticization section 581 is implemented will be described with reference to the flowchart that is shown in FIG. 17.

As shown in FIG. 17, in Step S41, the number of times of displacing the destaticization section M, which is a number of executions of the operation process of the destaticization section 581 is acquired. In the subsequent Step S42, it is determined whether or not the acquired number of times of displacing the destaticization section M is greater than or equal to a number of times of cleaning determination MTh that is set in advance. When the number of times of displacing the destaticization section M is greater than or equal to the number of times of cleaning determination MTh, it is possible to assume that the amount of foreign matter that is adhered to the destaticization section 581 is large.

Therefore, in a case in which the number of times of displacing the destaticization section M is greater than or equal to the number of times of cleaning determination MTh (Step S42: YES), the process thereof migrates to Step S43. Further, in Step S43, cleaning of the destaticization section 581 is implemented. That is, the cleaning member 66 is displaced from the retreat position to the sweeping position as a result of the action of the displacement mechanism section 67. Further, the destaticization section 581 is operated in this state. As a result of this, foreign matter is removed from the destaticization section 581 by the cleaning member 66. Further, when the operation of the destaticization section 581 is suspended, the cleaning member 66 is displaced from the sweeping position to the retreat position as a result of the action of the displacement mechanism section 67. When this happens, the process migrates to Step S44, the number of times of displacing the destaticization section M is reset to "0 (zero)", and thereafter, the present process is finished.

Meanwhile, in Step S42, in a case in which the number of times of displacing the destaticization section M is less than the number of times of cleaning determination MTh (NO), the process migrates to the subsequent Step S45. Further, in Step S45, it is determined whether or not the electric charge amount QR that was detected during a previous printing was greater than or equal to a cleaning determination electric charge amount QRTh2. In a case in which the electric charge amount QR is greater than or equal to cleaning determination electric charge amount QRTh2 (Step S45: YES), since it is possible to judge that the removal efficiency of an electric charge from a sheet of paper P by the destaticization section 581 is reduced, the process thereof migrates to the above-mentioned Step S43. Further, in Step S43, cleaning of the destaticization section 581 is performed. That is, cleaning of the destaticization section 581 is performed even is the number of times of displacing the destaticization section M is less than the number of times of cleaning determination MTh. Next, in the subsequent Step S44, the number of times of displacing the destaticization section M is reset to "0 (zero)", and thereafter, the present process is finished.

Meanwhile, in Step S45, in a case in which the electric charge amount QR that was detected during a previous printing is less than the cleaning determination electric charge amount QRTh2 (NO), it is possible to judge that the removal efficiency of an electric charge from a sheet of paper P by the destaticization section 581 is not reduced. Therefore, the present process is finished without cleaning of the destaticization section 581 being performed.

According to the printing apparatus 11 of the present embodiment that has been described above, in addition to the same effects as effects (1) to (5) and (7) in each embodiment of the above-mentioned first to fifth embodiments, it is possible to further obtain the following effects.

(12) In the printing apparatus 11 of the present embodiment, since it is possible to judge that the amount of foreign matter that is adhered to the destaticization section 581 is greater as the number of times of displacing the destaticization section M increases, the implementation timing of cleaning of the destaticization section 581 is decided on the basis of the number of times of displacing the destaticization section M. As a result of this, by setting the number of times of cleaning determination MTh to a suitable value, it is possible to perform cleaning of the destaticization section 581 at a suitable timing.

(13) In addition, since it is possible to judge that the removal efficiency of an electric charge from a sheet of paper P by the destaticization section 581 is reduced when the electric charge amount QR that is detected by the electric charge amount sensor SE3 is greater than or equal to the cleaning determination electric charge amount QRTh2, cleaning of the destaticization section 581 is executed. Therefore, it is possible to achieve optimization of the implementation timing of cleaning of the destaticization section 581, and furthermore, it is possible to suppress reductions in the removal efficiency of an electric charge from a sheet of paper P by the destaticization section 581.

Seventh Embodiment

In the seventh embodiment, a printing apparatus 11 that applies a DC voltage to the transport belt 53 will be described. In the first to sixth embodiments, an AC voltage is applied to the transport belt 53 via the charging roller 56, but in the seventh embodiment, a feature of applying a DC voltage to the transport belt 53 via the charging roller 56 is different from each embodiment of the first to sixth embodiments. Accordingly, in the following description, description will be given focusing on portions that differ from each embodiment of the first to sixth embodiments, the same reference numerals will be given to member configurations that are the same as those of each embodiment of the first to sixth embodiments, and overlapping descriptions thereof will be omitted.

Figure 18:
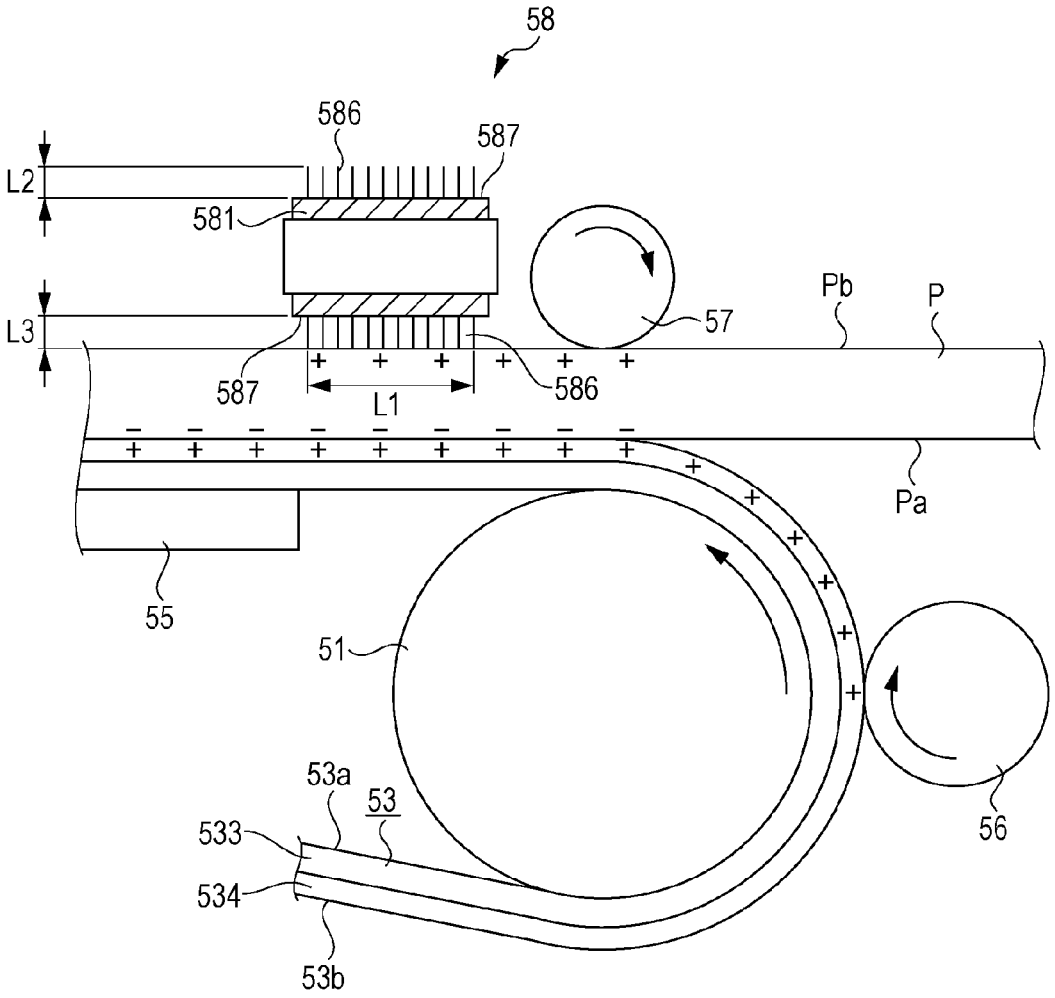
FIG. 18 is an action diagram that shows an aspect in which a transport belt is charged with an electric charge in a printing apparatus of a seventh embodiment.

FIG. 18 is an action diagram that shows an aspect in which the transport belt 53 is charged with an electric charge in the present embodiment. The transport belt 53 includes a conductive layer 533 that has a ring form, and a ring-shaped insulating layer 534 that is formed on an outer side of the conductive layer 533. The conductive layer 533 comes into contact with the grounded backup plate 55.

When a DC voltage is applied to the charging roller 56, the insulating layer 534 is charged with a positive electric charge. When a sheet of paper P is pressed against the transport belt 53 by the support roller 57, the sheet of paper P comes into close contact with the transport belt 53, and polarization is generated inside the sheet of paper P. That is, on the transport belt 53, a contact surface Pa side is charged with a negative electric charge, and a printing surface Pb side is charged with a positive electric charge.

When brushes 586 of the destaticization section 581 come into contact with the printing surface Pb, the positive electric charge of the printing surface Pb side is removed. As a result of this, decreases in the negative electric charge of the contact surface Pa side are suppressed, and reductions in an electrostatic adsorption force of sheets of paper P by the transport belt 53, are suppressed.

In a state in which the brushes 586 are applying a pressing force to a sheet of paper P that is adsorbed to the transport belt 53, a distance L3 of the brushes 586 from a support surface 587 to the printing surface Pb of the sheet of paper P is 5.5 mm, and a distance L2 of the brushes 586 that are positioned on an opposite side to the transport belt 53 and are vertically arranged from the support surface 587 is 6.5 mm.

Next, an abutting distance L1 of the destaticization section 581 will be described. The abutting distance L1 is a distance of a range over which the brushes 586 abut against the transport belt 53 in the transport direction (the left-right direction in the drawing).

Figure 19:
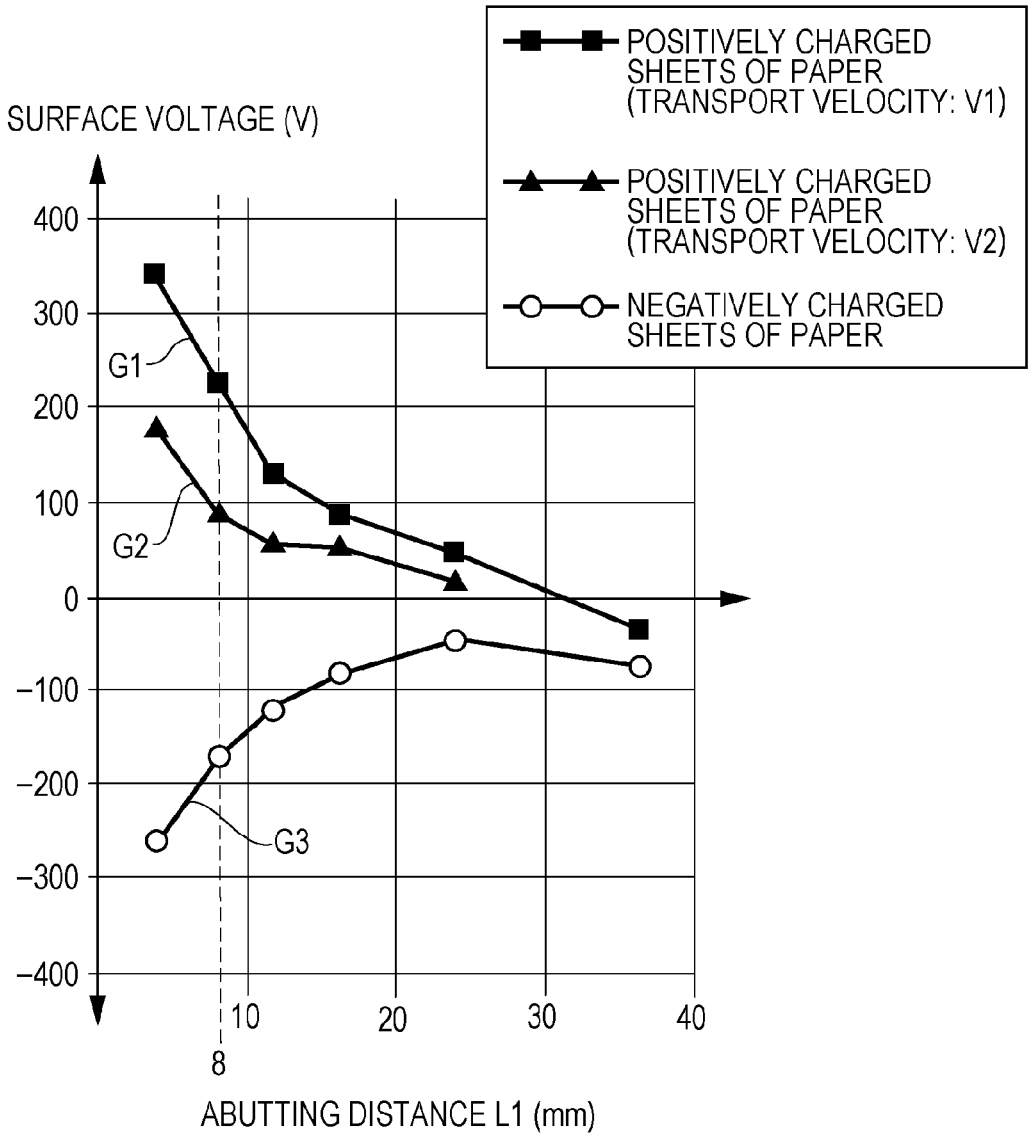
FIG. 19 is a graph that shows a relationship between an abutting distance of a destaticization section and a surface voltage of a sheet of paper in the printing apparatus of the seventh embodiment.

A surface voltage of sheets of paper P that are electrostatically adsorbed to and transported on the transport belt 53 changes depending on the abutting distance L1 of the destaticization section 581. FIG. 19 is a graph that shows a relationship between the abutting distance L1 of the destaticization section 581 and a surface voltage of sheets of paper P. The horizontal axis shows the abutting distance L1, and the vertical axis shows the surface voltage of sheets of paper P.

FIG. 19 is graph in which a plurality of destaticization sections 581 with different abutting distance L1 were prepared, and the surface voltage of sheets of paper P that is electrostatically adsorbed to and transported on the transport belt 53 was measured in each state in which the respective destaticization sections 581 were provided.

The polygonal line G1 shows results that measured the surface voltage of positively-charged sheets of paper P by performing transport at a transport velocity V1, and the polygonal line G2 shows results that measured the surface voltage of positively-charged sheets of paper P by performing transport at a transport velocity V2. The transport velocity V2 is a transport velocity that is half of the transport velocity V1. The same positively-charged sheets of paper P was used when obtaining the measurement results of the polygonal line G1 and the polygonal line G2. As shown in FIG. 19, the surface voltage of sheets of paper P that are positively charged is reduced as the abutting distance L1 of the destaticization section 581 increases.

The polygonal line G3 is a line for which the surface voltage was measured when negatively-charged sheets of paper P were transported. When the abutting distance L1 is less than 30 mm, an absolute value of the surface voltage becomes smaller as the abutting distance L1 increases.

Positively-charged paper debris (not illustrated in the drawing) from the printing surface Pb side of the sheet of paper P in FIG. 18 are electrically swept up by the grounded printing head 141 in FIG. 3, and the nozzles become blocked. A distance between the printing head 141 and the transport belt 53 in a direction in which ink is discharged from the printing head 141 is 0.9 mm.

When the nozzles become blocked, dots that forms an image are omitted. In such an instance, a configuration in which dot omission does not occur is performed by specifying a single blocked nozzle, and discharging ink from an adjacent nozzle in place of the blocked nozzle.

Figure 20:
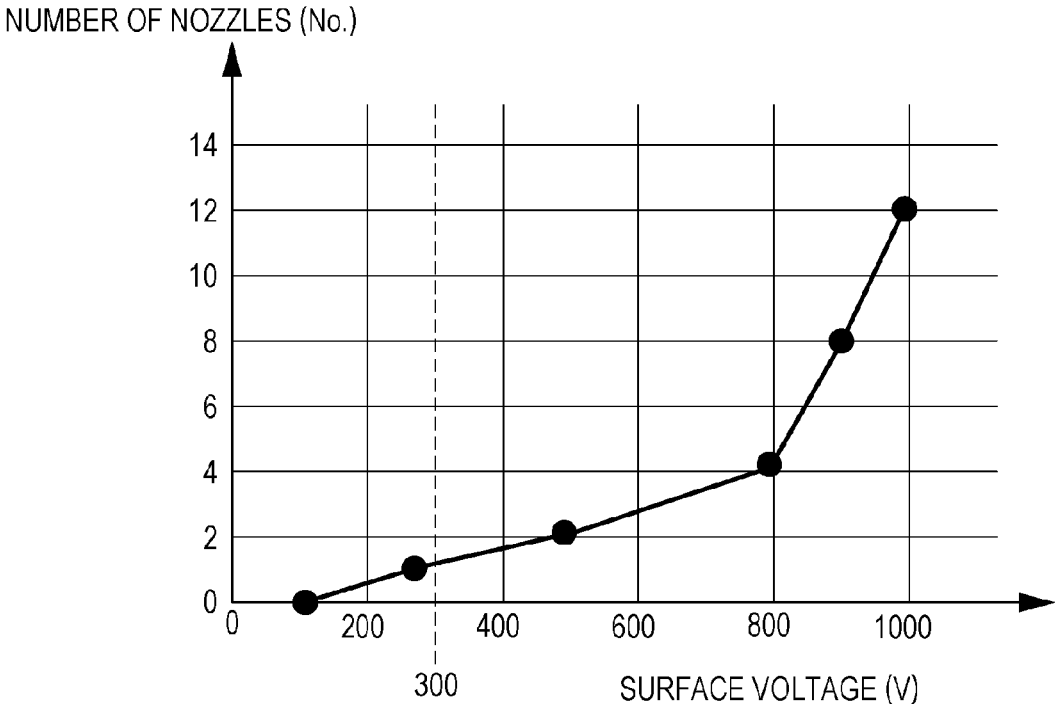
FIG. 20 is a graph that shows a relationship between a surface voltage of a sheet of paper and the number of blocked nozzles in the printing apparatus of the seventh embodiment.

FIG. 20 is a graph that shows a relationship between a surface voltage of a positively-charged sheet of paper P and a number of blocked nozzles. As shown in FIG. 20, when the surface voltage of the positively-charged sheet of paper P is less than or equal to 300 V, the number of blocked nozzles is less than or equal to 1.

In such an instance, in the present embodiment, a destaticization section 581 in which the abutting distance L1 in FIG. 19 is 8 mm is selected, and the surface voltage of a positively-charged sheet of paper P is set to less than 300 V. As a result of this, it is possible to set the number of blocked nozzles to less than or equal to 1. Further, it is possible to set so that dot omission does not occur by discharging ink from an adjacent nozzle in place of a blocked nozzle.

In the present embodiment, the insulating layer 534 was charged with a positive electric charge, but the insulating layer 534 may be charged with a negative electric charge.

Additionally, the abovementioned embodiments may be changed in the following manner.

Figure 21:
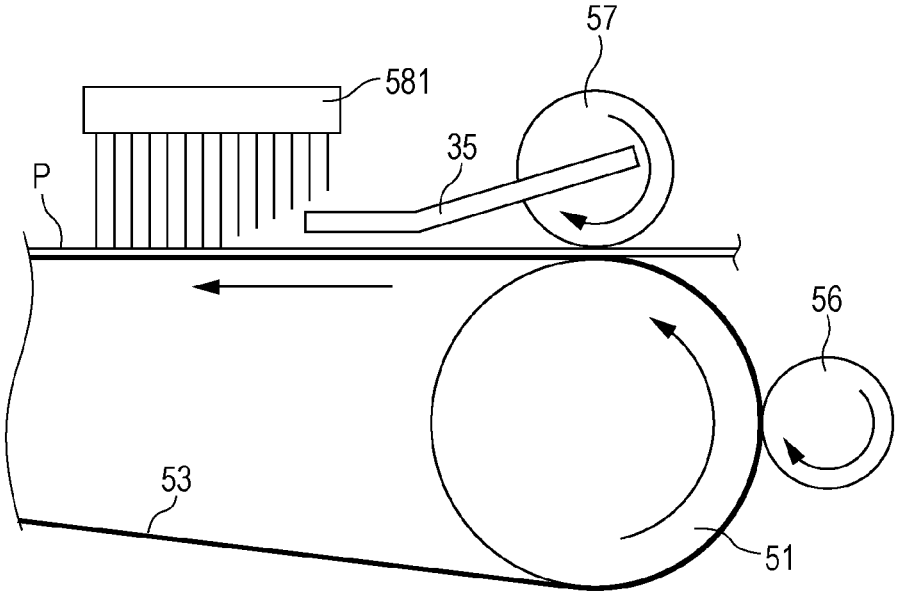
FIG. 21 is a side view that schematically shows a destaticization section and the peripheral members thereof in a printing apparatus of another embodiment.

The destaticization section 581 is pressed against the transport belt 53 with a comparatively large force. Therefore, for example, as shown in FIG. 21, a configuration in which a section of the destaticization section 581 that is on the upstream side in the transport direction (the right side in the drawings) is notched, and it is possible to induce sheets of paper P between the destaticization section 581 and the transport belt 53, may be used. In addition, as shown in FIG. 21, a guide member 35 for guiding sheets of paper P between the destaticization section 581 and the transport belt 53, may be provided. In this case, the guide member 35 may be disposed so that a leading end of the guide member 35 is positioned further on the downstream side in the transport direction than an upstream end of the destaticization section 581.

Figure 22:
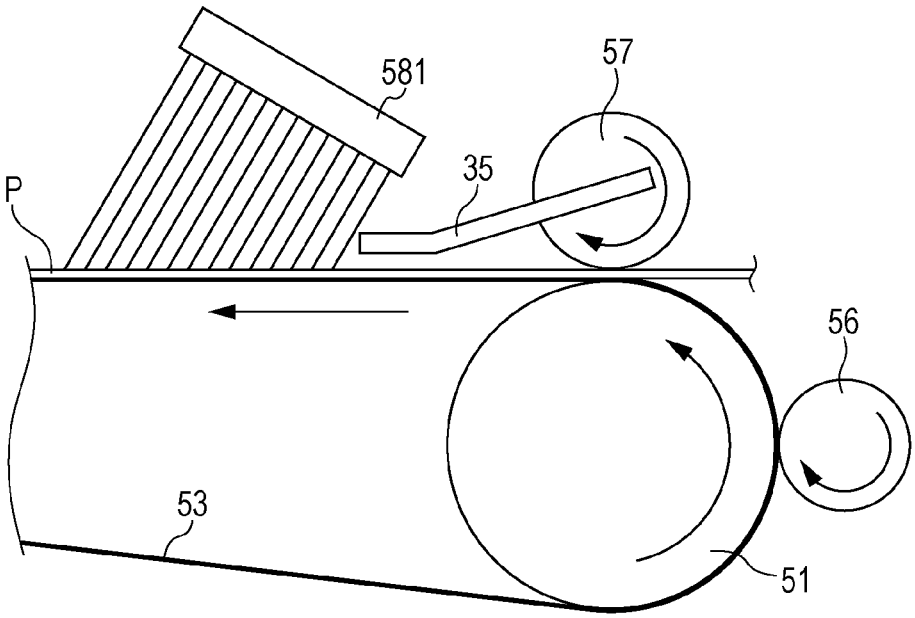
FIG. 22 is a side view that schematically shows a destaticization section and the peripheral members thereof in a printing apparatus of still another embodiment.

In addition, as shown in FIG. 22, the destaticization section 581 may be disposed in an inclined manner so that it is easy to induce sheets of paper P between the destaticization section 581 and the transport belt 53. In this case, unlike the example that is shown in FIG. 21, a section of the destaticization section 581 need not be notched.

In the sixth embodiment, cleaning of the destaticization section 581 may be performed when maintenance of the printing head 141 is being performed.

In the third embodiment, the operation process of the destaticization section 581 is implemented in a case of switching from the first printing mode to the second printing mode, and a case of switching from the second printing mode to the first printing mode. However, the embodiment is not limited to this, and since the first printing mode is a mode for forming a high resolution image on sheet of paper P, the operation process may be implemented when switching from the second printing mode to the first printing mode, that is, when the printing mode changes to the high resolution mode. In this case, the operation process need not be implemented when switching from the first printing mode to the second printing mode, that is, when the printing mode changes to the low resolution mode.

In addition, the operation process may always be performed prior to printing when performing printing with the first printing mode.

In the second embodiment, the operation process of the destaticization section 581 is implemented after printing based on a single printing job is finished, but the operation process may be implemented before initiating printing based on a subsequent printing job. Even in this case, it is possible to make the location of the destaticization section 581 that comes into contact with a sheet of paper P, which is electrostatically adsorbed to the transport belt 53, differ during printing based on a new printing job, and during printing based on a previous printing job. Accordingly, it is possible to obtain the same effect as that of (8) above.

In the second embodiment, cleaning of the destaticization section 581 may be implemented after printing based on a printing job is performed a specific number of times.

Since it is possible to change the location of the destaticization section 581 that comes into contact with a sheet of paper P by implementing the operation process, the operation amount of the destaticization section 581 need not necessarily be decided depending on the above-mentioned exchange movement amount Lbp. For example, the operation amount of the destaticization section 581 may be set to be constant regardless of the size of a sheet of paper P, which is a printing target.

As long as the backup plate 55 is configured by a conductive material, the backup plate 55 may be configured by a material other than a metallic material.

Since it is possible to electrostatically adsorb sheets of paper P to the transport belt 53 without removing an electric charge of the insulating layer 531 of the transport belt 53, the backup plate 55 need not necessarily be grounded. In this case, the backup plate 55 may be configured by material that is not a conductive material.

Since it is possible to sufficiently secure tension of the transport belt 53 even if tension is not added to the transport belt 53 by the backup plate 55, the transport belt 53 need not necessarily be biased toward the printing head 141 side by the backup plate 55.

In each of the embodiments, the transport belt 53 is configured by the insulating layer 531 and the conductive layer 532, but since it is possible to sufficiently secure an electrostatic adsorption force of sheet of paper P by the transport belt 53, a transport belt that adopts a configuration other than this may also be used.

In the fourth and sixth embodiments, it may be judged that the destaticization section 581 has deteriorated in a case in which the electric charge amount QR that is detected by the electric charge amount sensor SE3 does not become smaller even if cleaning of the destaticization section 581 is performed, and a report process that prompts exchange of the destaticization section 581 may be implemented.

In each embodiment, the definition direction, which is a direction in which the destaticization section 581 extends coincides with the width direction of sheets of paper that are electrostatically adsorbed to the transport belt 53. However, as long as the printing head 141 is not positioned on an extension line in which the destaticization section 581 extends, the definition direction may be changed as appropriate. For example, the definition direction may be set an arbitrary direction as long as the direction is a direction in which the width direction of sheets of paper that are electrostatically adsorbed to the transport belt 53 is set as a main component thereof.

In each embodiment, the cleaning sections 65 and 65A are disposed further on one side in the width direction Z of sheets of paper than the transport belt 53 (that is, a side on which the operation driving roller 584 is disposed). However, the invention is not limited to this, and for example, the cleaning sections 65 and 65A may be disposed further on the other side in the width direction Z of sheets of paper than the transport belt 53 (that is, a side on which the operation driven roller 585 is disposed).

In each embodiment the destaticization section 581 has a ring shape, but the invention is not limited to this, and an oblong destaticization section that extends in one direction may also be adopted. In this case, it is possible to change the position of the destaticization section that comes into contact with a sheet of paper P by moving the destaticization section in the definition direction in a sliding manner. That is, in such a configuration, a sliding movement of the destaticization section corresponds to "operation of the destaticization section". In this case, the cleaning member 66 may be disposed on both sides of the transport belt 53 in the width direction Z of sheets of paper.

In each embodiment, one end of the destaticization section 581 in the definition direction is positioned further on an outer side in the definition direction than one end of the transport belt 53, and the other end of the destaticization section 581 in the definition direction is positioned further on an outer side in the definition direction than the other end of the transport belt 53. However, since it is possible for the destaticization section 581 to come into contact with sheets of paper P that are transported on the transport belt 53 across the entire area thereof in the width direction Z, one end of the destaticization section 581 in the definition direction may be positioned further on an outer side in the definition direction than one end of the transport belt 53, and the other end of the destaticization section 581 in the definition direction may be positioned further on an inner side in the definition direction than the other end of the transport belt 53. In this case also, it is possible to perform cleaning of the destaticization section 581 in a position that is further on an outer side in the definition direction than the transport belt 53.

The printing unit 14 may be a unit that discharges an ink onto the printing surface of a sheet of paper from the printing head while moving the printing head in a predetermined scanning direction. In addition, the printing unit 14 may be a lateral scan type unit that discharges an ink onto a sheet of paper P from the printing head 141 while moving the printing head 141 in the transport direction of sheets of paper.

In each embodiment, as long as the printing apparatus can form an image on sheets of paper P, it is possible to adopt an arbitrary ink as a printing material. That is, the printing material may be granular, tear-shaped, of a form that leaves a trail. For example, the printing material may be any material in a state in which the matter is in a liquid phase, and includes liquid state materials with high and low viscosities, and fluid state materials such as sols, gel waters, other inorganic solvents, organic solvents, liquid solutions, liquid resins, liquid metals (metallic melts). In addition, the printing material includes liquids in which particles of an organic material that is formed from solid matter such as a pigment or a metal particle is dissolved, dispersed, or mixed into a solvent in addition to just liquids as a single substance state. An ink, a liquid crystal or the like such as that described in the above-mentioned embodiments can be given as a representative example of the printing material. In this instance, ink includes various liquid compositions such as a general water-based ink or oil-based ink, a gel ink, or a hot melt ink.

The printing medium on which printing is carried out by the printing apparatus may be another medium other than sheets of paper as long as the medium is capable of being electrostatically adsorbed to the transport belt 53.

The entire disclosure of Japanese Patent Application No.: 2015-035395, filed Feb. 25, 2015 and No.: 2016-004162, filed Jan. 13, 2016 are expressly incorporated by reference herein.

What is claimed is:

1. A printing apparatus comprising:

a transport belt, to which a printing medium is electrostatically adsorbed, and which operates in a manner that transports the printing medium in a transport direction;

a printing head that prints on a printing surface of the printing medium, which is electrostatically adsorbed to the transport belt;

a destaticization section that is disposed further upstream in the transport direction than the printing head, the destaticization section removes an electric charge from the printing surface by coming into contact with the printing surface of the printing medium, wherein, a first direction runs along the printing surface of the printing medium that is transported on the transport belt, and of which a width direction of the printing medium is the main component, an end of the destaticization section in the first direction being positioned further on an outer side than an end of the transport belt in the first direction, wherein an operation mechanism section is configured to change a location, in the first direction, of the destaticization section by operating the destaticization section, and wherein the destaticization section has a ring shape, wherein the operation mechanism section includes an operation driving roller and an operation driven roller, wherein the destaticization section is wound around each of the operation driving roller and the operation driven roller, and wherein the transport belt is disposed between each of the rollers in the first direction.

2. The printing apparatus according to claim 1, further comprising a cleaning section that performs cleaning of the destaticization section at a position that is further on an outer side in the definition direction than the transport belt.

3. The printing apparatus according to claim 1, wherein the transport belt is configured to have an endless form and is rotated by a transport driving roller, a printing medium, which is electrostatically adsorbed to an outer surface of the transport belt, is transported in the transport direction through rotation of the transport belt by the transport driving roller, and wherein the printing apparatus further comprises a belt biasing member that biases a portion of the transport belt that faces the printing head toward a printing head side by coming into contact with an inner surface of the transport belt.

4. The printing apparatus according to claim 3, wherein the belt biasing member includes a conductive material, and is grounded.

5. The printing apparatus according to claim 4, wherein the transport belt has a configuration in which an outer side thereof is formed using a conductive layer, and an inner side thereof is formed using an insulating layer with greater electrical resistance than the conductive layer, and wherein an outer surface of the conductive layer is an outer surface of the transport belt, and an inner surface of the insulating layer is an inner surface of the transport belt.

6. The printing apparatus according to claim 5, further comprising a destaticization control section that controls the operation mechanism section on the basis of a length in the width direction of a printing medium, when the location of the destaticization section that comes into contact with a printing medium is changed.

7. The printing apparatus according to claim 6, wherein the printing medium is supplied to a center in the width direction, on the transport belt, and wherein, in a case in which a sum of half of the length, in the width direction, of a printing medium, and half of the transport belt, in the width direction, is set as an exchange movement amount, the destaticization control section controls the operation mechanism section on the basis of the exchange movement amount when the location of the destaticization section that comes into contact with a printing medium is changed.

8. The printing apparatus according to claim 6, wherein the printing medium is supplied to one end side in the width direction on the transport belt, and wherein, in a case in which the length in the width direction of a printing medium, is set as an exchange movement amount, the destaticization control section controls the operation mechanism section on the basis of the exchange movement amount when the location of the destaticization section that comes into contact with a printing medium is changed.

9. The printing apparatus according to claim 8, wherein the destaticization control section changes the location of the destaticization section that comes into contact with a printing medium by the destaticization control section controlling the operation mechanism section using as a trigger a number of times of printing on the printing surface of a printing medium becoming equal to the number of times of moving.

10. The printing apparatus according to claim 8, further comprising a printing control section that prints on a printing medium by operating the transport belt and controlling the printing head when a printing job is input, wherein the destaticization control section changes the location of the destaticization section that comes into contact with a printing medium by controlling the operation mechanism section when printing on a printing medium based on the printing job is completed, or when printing on a printing medium based on the printing job is initiated.

11. The printing apparatus according to claim 8, wherein a plurality of printing modes, in which the resolution of an image that is formed on the printing surface of the printing medium differs, are prepared, and wherein the destaticization control section changes the location of the destaticization section that comes into contact with a printing medium by controlling the operation mechanism section using the printing mode changing as a trigger thereof.

12. The printing apparatus according to claim 8, further comprising an electric charge amount sensor that is positioned between the destaticization section and the printing head in the transport direction, and that detects an amount of an electric charge of the printing surface of a printing medium, wherein the destaticization control section changes the location of the destaticization section that comes into contact with a printing medium, by controlling the operation mechanism section when the amount of the electric charge that is detected by the electric charge amount sensor becomes greater than or equal to a movement electric charge amount up until before subsequent printing is initiated.

13. The printing apparatus according to claim 8, further comprising a reversal mechanism that, after printing on a first surface of the two surfaces of a printing medium is completed, guides the printing medium onto the transport belt by reversing the top and bottom of the printing medium so that a second surface, which is a surface that is on an opposite side to the first surface, becomes the printing surface, wherein the destaticization control section changes the location of the destaticization section that comes into contact with a printing medium by controlling the operation mechanism section while a printing medium is being supplied onto the transport belt by the reversal mechanism.

14. The printing apparatus according to claim 1, wherein the cleaning section includes a cleaning member that cleans the destaticization section by coming into contact with the destaticization section, and a displacement mechanism section that displaces the cleaning member between a sweeping position at which the cleaning member is capable of coming into contact with the destaticization section and a retreat position at which the cleaning member is not capable of coming into contact with the destaticization section.

15. The printing apparatus according to claim 14, wherein the cleaning section cleans the destaticization section when maintenance of the printing head is being performed.

16. The printing apparatus according to claim 14, wherein the cleaning section cleans the destaticization section when the number of times of displacing the destaticization section, which is the number of times that the location of the destaticization section that comes into contact with a printing medium is changed, becomes the number of times of cleaning determination.

17. The printing apparatus according to claim 14, further comprising an electric charge amount sensor that is positioned between the destaticization section and the printing head in the transport direction, and that detects an amount of an electric charge of the printing surface of a printing medium, wherein the cleaning section cleans the destaticization section when the amount of the electric charge that is detected by the electric charge amount sensor becomes greater than or equal to the cleaning determination electric charge.

* * * * *